US011778383B2

(12) United States Patent
Lopez Zuleta et al.

(10) Patent No.: US 11,778,383 B2
(45) Date of Patent: Oct. 3, 2023

(54) ELECTRONIC DEVICE AND METHOD FOR REDUCING CROSSTALK, RELATED AUDIO SYSTEM FOR SEAT HEADRESTS AND COMPUTER PROGRAM

(71) Applicant: Faurecia Clarion Electronics Europe, Paris (FR)

(72) Inventors: Nicolas Lopez Zuleta, Montreuil (FR); Mounira Rigaud-Maazaoui, Paris (FR); Camille Georges, Sartrouville (FR)

(73) Assignee: Faurecia Clarion Electronics Europe, Paris (FR)

( * ) Notice: Subject to any disclaimer, the term of this patent is extended or adjusted under 35 U.S.C. 154(b) by 29 days.

(21) Appl. No.: 17/459,197

(22) Filed: Aug. 27, 2021

(65) Prior Publication Data

US 2022/0070587 A1 Mar. 3, 2022

(30) Foreign Application Priority Data

Aug. 28, 2020 (FR) ..... 20 08783

(51) Int. Cl.
*H04R 5/04* (2006.01)
*H04R 5/02* (2006.01)

(52) U.S. Cl.
CPC ..... *H04R 5/04* (2013.01); *H04R 5/023* (2013.01); *H04R 2499/13* (2013.01)

(58) Field of Classification Search
CPC ..... H04R 5/04; H04R 5/023; H04R 2499/13
See application file for complete search history.

(56) References Cited

U.S. PATENT DOCUMENTS 6,243,476 B1 * 6/2001 Gardner ..... H04S 3/002 381/1
9,860,643 B1 1/2018 Oswald
(Continued)

FOREIGN PATENT DOCUMENTS

DE 102014210105 A1 12/2015
EP 2389016 A1 11/2011
(Continued)

OTHER PUBLICATIONS

French Search Report corresponding to French Application No. FR 2008783, dated Apr. 20, 2021, 2 pages.

*Primary Examiner* — Daniel R Sellers
(74) *Attorney, Agent, or Firm* — REISING ETHINGTON P.C.

(57) ABSTRACT

A device for reducing crosstalk in an audio system that has first and second pairs of loudspeakers and first and second audio sources. The device is connected to each audio source and to at least the first pair of loudspeakers. The device includes a module for acquiring first audio signals from the first source and second audio signals from the second source, a module for determining crosstalk reduction filters resulting from a loudspeaker of the second pair, a module for calculating corrective signals, by applying the reduction filters to the second audio signals, and a module for generating corrected audio signals for the first pair, obtained from the first audio signals and corrective signals. Each reduction filter is obtained from transfer functions, each representing an acoustic path between a loudspeaker and a user's ear.

9 Claims, 10 Drawing Sheets

(56) References Cited

U.S. PATENT DOCUMENTS

| | | | | |
|---|---|---|---|---|
| 2004/0179693 | A1* | 9/2004 | Abel | H04S 1/002 381/1 |
| 2011/0286614 | A1 | 11/2011 | Hess | |
| 2013/0163766 | A1* | 6/2013 | Choueiri | H04S 1/002 381/17 |
| 2017/0053636 | A1 | 2/2017 | Oswald et al. | |
| 2019/0045316 | A1 | 2/2019 | Schneider et al. | |
| 2019/0104363 | A1* | 4/2019 | Vautin | H04R 3/12 |
| 2020/0029155 | A1* | 1/2020 | Bharitkar | H04R 3/14 |

FOREIGN PATENT DOCUMENTS

| | | | |
|---|---|---|---|
| EP | 2405670 | A1 | 1/2012 |
| EP | 3232688 | A1 | 10/2017 |
| EP | 3338465 | A2 | 6/2018 |
| WO | 2017030920 | A2 | 2/2017 |

* cited by examiner

ELECTRONIC DEVICE AND METHOD FOR REDUCING CROSSTALK, RELATED AUDIO SYSTEM FOR SEAT HEADRESTS AND COMPUTER PROGRAM

CROSS-REFERENCE TO RELATED APPLICATIONS

This application is a U.S. non-provisional application claiming the benefit of French Application No. 20 08783, filed on Aug. 28, 2020, which is incorporated herein by reference in its entirety.

TECHNICAL FIELD

The present invention relates to an electronic crosstalk reduction device for reducing crosstalk in an audio system, the audio system comprising a first pair of right and left loudspeakers intended for broadcasting acoustic signals to a user, a second pair of right and left loudspeakers, distinct from the first pair, intended for broadcasting acoustic signals to another user, and first and second distinct audio sources.

The invention also relates to an audio system for seat headrests, the audio system comprising two distinct pairs of right and left loudspeakers, each configured to be integrated into a respective seat headrest, two distinct audio sources and at least one such electronic crosstalk reduction device.

The invention also relates to a method for reducing crosstalk in such an audio system, the method being implemented by such an electronic crosstalk reduction device adapted to be connected to the output of each audio source and to the input of the first pair of loudspeakers.

The invention also relates to a non-transitory computer-readable medium comprising a computer program having software instructions that implement such a crosstalk reduction method, when executed by a computer.

The invention relates to the field of audio systems for passenger vehicles, in particular for motor vehicles.

BACKGROUND

Electronic crosstalk reduction devices of the above type are known from EP 2 405 670 A1 and U.S. Pat. No. 9,860,643 B1. These crosstalk reduction devices are each carried on board a vehicle and enable a reduction in crosstalk between seats in the vehicle, and, more particularly, between one pair of loudspeakers fitted to a seat headrest and another pair of loudspeakers fitted to another seat headrest.

However, the crosstalk reduction achieved with these crosstalk reduction devices is not always optimal.

SUMMARY

An object of the invention is therefore to provide an electronic device and associated method for reducing crosstalk that enables further reduction in the crosstalk between two pairs of loudspeakers and thus improve the listening experience of a user perceiving the sound broadcast by one pair of loudspeakers by limiting the crosstalk resulting from another pair of loudspeakers, and thus providing a better audio experience.

To this end, the invention relates to an electronic crosstalk reduction device for reducing crosstalk in an audio system, the audio system including a first pair of right and left loudspeakers for broadcasting acoustic signals to a user, a second pair of right and left loudspeakers, distinct from the first pair, for broadcasting acoustic signals to another user, and first and second distinct audio sources, the crosstalk reduction device being adapted to be connected to the output of each audio source and to the input of the first pair of loudspeakers, the crosstalk reduction device comprising:

- an acquisition module configured to acquire first right and left audio signals from the first source and second right and left audio signals from the second source;
- a determination module configured to determine two right and two left crosstalk reduction filters respectively, each being adapted to reduce the crosstalk resulting from a respective loudspeaker of the second pair for the respective ear of the user;
- a calculation module configured to calculate a respective right and left corrective signal by applying the respective right and left crosstalk reduction filters to the second audio signals,
- a generation module configured to generate a first corrected respective right and left audio signal to be played through the respective right and left loudspeaker of the first pair while playing the second right and left audio signals through the right and left loudspeakers of the second pair, each first corrected audio signal being obtained from the respective first audio signal and the corresponding corrective signal;
- each respective crosstalk reduction filter being obtained from first and second predefined transfer functions, each first transfer function representing an acoustic path between a loudspeaker of the first pair and a respective ear of the user, and each second transfer function being representing an acoustic path between a loudspeaker of the second pair and a respective ear of the user.

With the device according to at least some embodiments of the invention, the crosstalk reduction is calculated from the first and second predefined transfer functions, where each first transfer function is used to model the acoustic path between a loudspeaker of the first pair and a respective ear, and each second transfer function is used to model the acoustic path between a loudspeaker of the second pair and a respective ear. This crosstalk reduction calculation is thus more accurate, then enabling a more effective crosstalk reduction between the loudspeaker pairs to be obtained.

Preferably, each respective crosstalk reduction filter is obtained from at least one respective second transfer function and at least one respective inverse filter, wherein each respective inverse filter is obtained by inverting at least one first transfer function, in order to provide an even better reduction in crosstalk resulting from another pair of loudspeakers.

Even more preferably, in said inversion of a respective first transfer function, a regularization term is added to the denominator of a fraction representing said inversion, thereby providing a better stability of the inverse filter, and thus further improving the reduction in crosstalk.

According to other advantageous aspects of the invention, the electronic crosstalk reduction device comprises one or more of the following features, taken alone or in any technically possible combination:

- each respective crosstalk reduction filter is obtained from at least one respective second transfer function and at least one respective inverse filter, each respective inverse filter being obtained by inverting at least one first transfer function;
- for the inversion of at least a first transfer function, the determination module is configured to add a regularization term to the denominator of a fraction representing said inversion;

the determination module is configured to determine each respective crosstalk reduction filter in the frequency domain;

the calculation module preferably being configured to calculate each corrective signal in the frequency domain;

the regularization term is frequency dependent, the regularization term preferably having a minimum constant value for a predetermined range of frequencies and a value tending towards infinity outside said range;

the determination module is configured to determine the crosstalk reduction filters according to the following equations:

$$G_{ILL}(z)=-J_{SLL}(z)\cdot H_{ILL}(z)$$

$$G_{IRL}(z)=-J_{SLL}(z)\cdot H_{IRL}(z)$$

$$G_{ILR}(z)=-J_{SRR}(z)\cdot H_{ILR}(z)$$

$$G_{IRR}(z)=-J_{SRR}(z)\cdot H_{IRR}(z)$$

where $G_{ILL}$, $G_{IRL}$, $G_{ILR}$, $G_{IRR}$ represent the crosstalk reduction filters, $H_{ILL}$, $H_{IRL}$, $H_{ILR}$, $H_{IRR}$ represent the respective second transfer functions, and $J_{SLL}$, $J_{SRR}$ represent respective inverse filters, each equal to the inverse of the corresponding first transfer function $H_{SLL}$, $H_{SRR}$;

the determination module is configured to determine the crosstalk reduction filters according to the following equations:

$$G_{ILL}(z)=-J_{SLL}(z)\cdot H_{ILL}(z)-J_{SRL}(z)\cdot H_{ILR}(z)$$

$$G_{IRL}(z)=-J_{SLL}(z)\cdot H_{IRL}(z)-J_{SRL}(z)\cdot H_{IRR}(z)$$

$$G_{ILR}(z)=-J_{SRR}(z)\cdot H_{ILR}(z)-J_{SLR}(z)\cdot H_{ILL}(z)$$

$$G_{IRR}(z)=-J_{SRR}(z)\cdot H_{IRR}(z)-J_{SLR}(z)\cdot H_{IRL}(z)$$

where $G_{ILL}$, $G_{IRL}$, $G_{ILR}$, $G_{IRR}$ represent the crosstalk reduction filters, $H_{ILL}$, $H_{IRL}$, $H_{ILR}$, $H_{IRR}$ represent the respective second transfer functions, and $J_{SLL}$, $J_{SRL}$, $JSL_R$, $J_{SRR}$ represent the respective inverse filters;

the calculation module is configured to calculate the corrective signals according to the following equations:

$$C_L(z)=G_{ILL}(z)\cdot Y_{IL}(z)+G_{IRL}(z)\cdot Y_{IR}(z)$$

$$C_R(z)=G_{ILR}(z)\cdot Y_{IL}(z)+G_{IRR}(z)\cdot Y_{IR}(z)$$

where $C_L$, $C_R$ represent the left, and respectively right corrective signals, $G_{ILL}$, $G_{IRL}$, $G_{ILR}$, $G_{IRR}$ represent the crosstalk reduction filters, and $Y_{IL}$, $Y_{IR}$ represent the second left, and respectively right audio signals.

It is also an object of the invention to provide an audio system for seat headrests, the audio system comprising two distinct pairs of right and left loudspeakers, each configured to be integrated into a respective seat headrest, two distinct audio sources and at least one electronic crosstalk reduction device, as defined above.

The invention also relates to a method for reducing crosstalk in an audio system, the audio system including a first pair of right and left loudspeakers for broadcasting acoustic signals to a user, a second pair of right and left loudspeakers, distinct from the first pair, for broadcasting acoustic signals to another user, and first and second distinct audio sources, the method being implemented by an electronic crosstalk reduction device adapted to be connected to the output of each audio source and to the input of the first pair of loudspeakers, the method comprising the following steps:

acquiring first right and left audio signals from the first source and second right and left audio signals from the second source;

determining two right and two left crosstalk reduction filters, respectively, each adapted to reduce the crosstalk resulting from a respective loudspeaker of the second pair for the respective ear of the user; and calculating a right and left corrected signal by applying the right and left crosstalk reduction filters to the second audio signals;

generating a first corrected right and left audio signal to be played through the respective right and left loudspeaker of the first pair while playing the second right and left audio signals through the respective right and left loudspeaker of the second pair, each first corrected audio signal being obtained from the respective first audio signal and the corresponding corrective signal;

each respective crosstalk reduction filter being obtained from first and second predefined transfer functions, each first transfer function representing an acoustic path between a loudspeaker of the first pair and a respective ear of the user, and each second transfer function representing an acoustic path between a loudspeaker of the second pair and a respective ear of the user.

It is also an object of the invention to provide a non-transitory computer-readable medium comprising a computer program having software instructions that implement a crosstalk reduction method as defined above when executed by a computer.

It is a further object of the invention to provide a pair of seat headrests intended to be coupled to the respective seatbacks, equipped with an audio system as defined above, each pair of loudspeakers being integrated into a respective seat headrest.

The invention also relates to a passenger transport vehicle, in particular a motor vehicle, the transport vehicle comprising a plurality of seats, at least two seats having a pair of seat headrests as defined above.

The invention also relates to an electronic crosstalk reduction device for reducing crosstalk in an audio system, as defined above, wherein the calculation module is configured to calculate a respective right and left corrective signal by applying the respective right and left crosstalk reduction filters only to the second audio signals.

Thus, according to this further aspect of the invention, the transfer functions are applied only to the respective second audio signal and not to the first audio signal, that is, the corrective signal is calculated by applying the crosstalk reduction filters only to the respective second audio signal and not to the first audio signal and, next, the corrected first audio signal is then obtained by adding the unchanged first audio signal and the corrective signal thus calculated.

In other words, the person skilled in the art will understand that the corrected signal, according to this further aspect of the invention, is calculated by applying the crosstalk reduction filters only to the respective second audio signal and not to the first audio signal.

This additional aspect of the invention then allows for simplification of the calculation of the corrective signal, as compared to the calculation performed by an electronic crosstalk reduction device of the prior art.

BRIEF DESCRIPTION OF THE DRAWINGS

These features and advantages of the invention will become clearer upon reading the following description, given only as a non-limiting example, and made with reference to the appended drawings, in which.

DETAILED DESCRIPTION

In the following description, the term "substantially equal to" defines a relationship of equality to plus or minus 10%, preferably plus or minus 5%.

Figure 1:
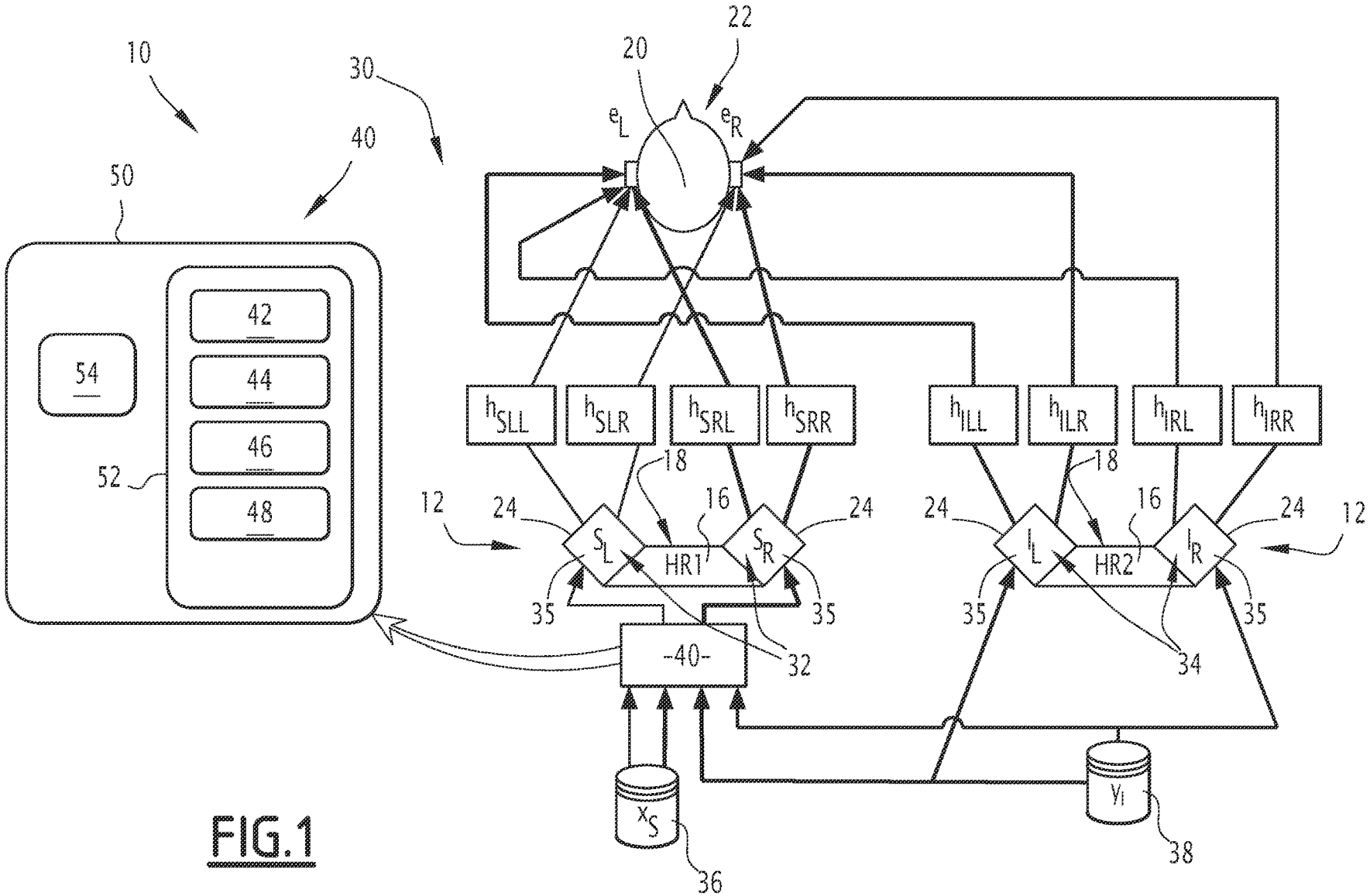
FIG. 1 is a schematic view of a passenger transport vehicle comprising a plurality of seats, each equipped with a headrest, and a seat headrest audio system, the audio system comprising two distinct pairs of right and left loudspeakers, each configured to be integrated into a respective seat headrest, two distinct audio sources and at least one electronic device for reducing crosstalk, each crosstalk reduction device being adapted to be connected to the output of each audio source and to the input of a respective pair of loudspeakers, and comprising a module for acquiring first right and left audio signals from the first source and second right and left audio signals from the second source, a module for determining two right filters and two left crosstalk reduction filters respectively, each adapted to reduce the crosstalk resulting from a respective loudspeaker of the second pair, for the respective ear of the user, a module for calculating a respective right and left corrective signal by applying the respective right and left crosstalk reduction filters to the second audio signals and a module for generating a first corrected respective right and left audio signal, to be broadcast via the respective right and left loudspeaker of the first pair during the broadcasting of the second right and left audio signals via the loudspeakers of the second pair, each first corrected audio signal being obtained from the respective first audio signal and the corresponding corrective signal; according to a first embodiment of the invention.

In FIG. 1, a passenger vehicle 10, particularly a motor vehicle, includes a plurality of seats, not shown, at least two seats including a pair of seat headrests 12, namely a first seat headrest 12, also noted HR1, and a second seat headrest 12, also noted HR2.

Each headrest 12 is intended to be mechanically coupled to a seatback, not shown, of a respective seat. Each headrest 12 includes a central body 16, typically forming an area 18 for supporting the head 20 of a user 22.

As an optional addition, at least one headrest 12 comprises at least one side flap 24, positioned laterally relative to the central body 16, i.e. positioned on one side of the central body 16 relative to a direction of extension of the seatback to which said headrest is coupled.

In the example shown in FIG. 1, the headrest 12 comprises two side flaps 24 positioned on either side of the central body 16, namely a right and a left side flap, with right and left being defined relative to the direction of travel of said vehicle. Each side flap 24 is preferably movable relative to the central body 16, and rotatable relative to the seatback extension axis, for example. The seatback extension axis generally extends substantially vertically. Each side flap 24 is hinged relative to the central body 16, for example.

At least one pair of headrests 12 is equipped with a seat headrest audio system 30.

The audio system 30 comprises two distinct pairs 32, 34 of right and left loudspeakers 35. More specifically, the audio system 30 comprises a first pair 32 of right and left loudspeakers 35, also noted as SR and SL respectively in FIG. 1, for broadcasting acoustic signals to the user 22. The audio system 30 comprises a second pair 34 of right and left loudspeakers 35, also noted $I_R$ and $I_L$ respectively, this second pair 34 being distinct from the first pair 32 and intended to broadcast acoustic signals to another user, not shown, distinct from the user 22.

The audio system 30 also includes two distinct audio sources 36, 38, namely a first audio source 36, configured to provide first right and left audio signals $x_s$ for playback through the respective right and left loudspeakers 35 of the first pair 32, and a second audio source 38, configured to provide second right and left audio signals $y_I$ for playback through the respective right and left loudspeakers 35 of the second pair 34.

The person skilled in the art will observe that, by convention and in the present description, the lower-case notations x, y, c, e for the signals and lower-case h for the transfer functions, optionally followed by a specific "(t)", correspond to signals and transfer functions in the time domain; and that the upper-case notations X, Y, C for the signals and upper-case H for the transfer functions, optionally followed by a specific "(z)", correspond to signals and transfer functions in the frequency domain. Further, these lower-case letter notations refer to the same signals and transfer functions in the time domain whether or not the specific "(t)" is present; and similarly these upper-case letter notations refer to the same signals and transfer functions in the frequency domain, whether or not the specific "(z)" is present.

The audio system 30 comprises at least one electronic crosstalk reduction device 40 connected to the output of each audio source 36, 38 and to the input of a respective pair 32, 34 of loudspeakers 35.

The audio system 30 preferably comprises two crosstalk reduction devices 40, such as a left crosstalk reduction device 40 connected to the left and right audio source output and to the input of a left pair of loudspeakers, and a right crosstalk reduction device 40 connected to the left and right audio sources output and to the input of a right pair of loudspeakers. The person skilled in the art will then understand that, for the left crosstalk reduction device 40, the first pair 32 of loudspeakers is the left pair, and the second pair 34 of loudspeakers is the right pair, with the first audio source 36 being the left source and the second audio source 38 being the right source; and conversely for the right crosstalk reduction device 40, the first pair 32 of loudspeakers is the right pair, and the second pair 34 of loudspeakers is the left pair, with the first audio source 36 being the right source and the second audio source 38 being the left source.

When the audio system 30 comprises two crosstalk reduction devices 40, the person skilled in the art will of course understand that other variants are possible, such as a variant with a front crosstalk reduction device 40 connected to the front and rear audio sources output and to the input of a front pair of loudspeakers, and a rear crosstalk reduction device 40 connected to the front and rear audio sources output and to the input of a rear pair of loudspeakers. According to this variant, the person skilled in the art will further observe that for the front crosstalk reduction device 40, the first pair 32 of loudspeakers is the front pair, and the second pair 34 of loudspeakers is the rear pair, with the first audio source 36 being the front source and the second audio source 38 being the rear source; and, conversely, for the rear crosstalk reduction device 40, the first pair 32 of loudspeakers is the rear pair, and the second pair 34 of loudspeakers is the front pair, with the first audio source 36 being the rear source and the second audio source 38 being the front source.

In the example shown in FIG. 1, for simplicity in the drawings, only one crosstalk reduction device 40 is shown.

Each pair 32, 34 of loudspeakers is configured to be integrated into a respective headrest 12, that is, configured to be received in slots in the headrest 12 provided for that purpose, as shown in FIG. 1. When, an optional addition, the headrest 12 comprises at least one side flap 24, at least one loudspeaker 35 is preferably integrated into a respective side flap 24. When, as a further optional addition, the headrest 12 comprises two side flaps 24 positioned on opposite sides of the central body 16, each loudspeaker 35 is preferably integrated into a respective side flap 24.

The crosstalk reduction device 40, connected to the output of each audio output 36, 38 and to the input of the first pair 32 of loudspeakers, comprises a module 42 for acquiring the first audio signals $x_s$ and the second audio signals $y_I$, a module 44 for determining two right crosstalk reduction filters $G_{ILR}$, $G_{IRR}$ and two left crosstalk reduction filters $G_{ILL}$, $G_{IRL}$ respectively, each being able to reduce the crosstalk resulting from a respective loudspeaker 35 of the second pair 34 for the respective ear of the user 22, a module 46 for calculating a respective right $C_R$ and left $C_L$ corrective signal by applying the right $G_{ILR}$, $G_{IRR}$ and left $G_{ILL}$, $G_{IRL}$ crosstalk reduction filters, respectively, to the second audio signals $y_I$; and a module 48 for generating a first corrected right $v_R$ and left $v_N$ audio signal, respectively, intended to be broadcast via the right and left loudspeaker, respectively, of the first pair 32 during the broadcasting of the second right and left $y_I$ audio signals via the loudspeakers of the second pair 34.

In the example of FIG. 1, the electronic crosstalk reduction device 40 comprises an information processing unit 50 formed of a memory 52 and a processor 54 connected to the memory 52.

In the example of FIG. 1, the acquisition module 42, the determination module 44, the calculation module 46 and the generation module 48 are each implemented as software, or a software brick, executable by the processor 54. The memory 52 of the crosstalk reduction device 40 is then adapted to store software for acquiring the first audio signals and second audio signals, software for determining the crosstalk reduction filters, software for calculating the corrective signals by applying the crosstalk reduction filters to the corresponding audio signals, and software for generating the corrected audio signals intended to be broadcast via the loudspeakers of the first pair during the broadcast of the second audio signals via the loudspeakers of the second pair. The processor 54 is then adapted to execute each of the acquisition software, the determination software, the calculation software, and the generation software.

In a variant, not shown, the acquisition module 42, the determination module 44, the calculation module 46 and the generation module 48 are each implemented as a programmable logic component, such as an FPGA (Field Programmable Gate Array), or a dedicated integrated circuit, such as an ASIC (Application Specific Integrated Circuit).

When the crosstalk reduction device 40 is made in the form of one or more software programs, that is, as a computer program, it is further adapted to be stored on a computer-readable medium, not shown. The computer-readable medium is, a medium capable of storing electronic instructions and of being coupled to a bus of a computer system, for example. By way of example, the readable medium is an optical disk, a magneto-optical disk, a ROM memory, a RAM memory, any type of non-volatile memory (e.g. EPROM, EEPROM, FLASH, NVRAM), a magnetic card or an optical card. A computer program comprising software instructions is then stored on the readable medium.

The acquisition module 42 is configured to acquire the first right and left audio signals $x_s$ from the first source 36, and the respective second right and left audio signals $y_I$ from the second source 38. Hereinafter, the first right and left signals are denoted $x_{SR}$ and $x_{SL}$, respectively; and the second right and left audio signals are denoted $y_{IR}$ and $y_{IL}$, respectively.

As an optional addition, the acquisition module 42 is configured to convert the acquired signals, that is, the first right and left audio signals $x_s$ and the respectively second right and left audio signals $y_I$ from the time domain to the first right and left audio signals $x_s$, and the respective second right and left audio signals $Y_I$, into the frequency domain. The conversion from the time domain to the frequency domain is performed via the application of a Fourier Transform, for example, such as a local Fourier Transform, also called Short-Time Fourier Transform, or also called Sliding Window Fourier Transform, to each audio signal $x_s$, $y_I$.

The determination module 44 is configured to determine two right crosstalk reduction filters $G_{ILR}$, $G_{IRR}$, and two respective left crosstalk reduction filters $G_{ILL}$, $G_{IRL}$, each of which is adapted to reduce the crosstalk resulting from a respective loudspeaker 35 of the second pair 34 for the respective ear of the user 22. More specifically, each right crosstalk reduction filter $G_{ILR}$, $G_{IRR}$ is adapted to reduce the crosstalk resulting from a respective loudspeaker 35 of the second pair 34 for the user's right ear 22, and each left crosstalk reduction filter $G_{ILL}$, $G_{IRL}$ is adapted to reduce, the crosstalk resulting from a respective loudspeaker 35 of the second pair 34 for the user's left ear 22.

Each respective crosstalk reduction filter $G_{ILL}$, $G_{ILR}$, $G_{IRL}$, $G_{IRR}$ is obtained from first $H_{SLL}$, $H_{SLR}$, $H_{SRL}$, $H_{SRR}$ and second $H_{ILL}$, $H_{ILR}$, $H_{IRL}$, $H_{IRR}$ predefined transfer functions, each first transfer function $H_{SLL}$, $H_{SLR}$, $H_{SRL}$, $H_{SRR}$ representing an acoustic path between a loudspeaker 35 of the first pair 32 and a respective ear of the user 22, and each second transfer function $H_{ILL}$, $H_{ILR}$, $H_{IRL}$, $H_{IRR}$ representing an acoustic path between a loudspeaker 35 of the second pair 34 and a respective ear of the user 22.

By convention, the crosstalk reduction filter $G_{ILR}$ is adapted to reduce the crosstalk resulting from the left loudspeaker of the second pair 34 for the user's right ear 22; the crosstalk reduction filter $G_{IRR}$ being adapted to reduce the crosstalk resulting from the right loudspeaker of the second pair 34 for the user's right ear 22; the crosstalk reduction filter $G_{ILL}$ being adapted to reduce the crosstalk resulting from the left loudspeaker of the second pair 34 for the left ear of the user 22; and the crosstalk reduction filter $G_{ILR}$ being adapted to reduce the crosstalk resulting from the right loudspeaker of the second pair 34 for the left ear of the user 22.

The first transfer function $H_{SLL}$ represents the acoustic path between the left loudspeaker of the first pair 32 and the left ear of the user 22; the first transfer function $H_{SLR}$ represents the acoustic path between the left loudspeaker of the first pair 32 and the right ear of the user 22; the first transfer function $H_{SRL}$ represents the acoustic path between the right loudspeaker of the first pair 32 and the left ear of the user 22; and the first transfer function $H_{SRR}$ represents the acoustic path between the right loudspeaker of the first pair 32 and the right ear of the user 22.

The second transfer function $H_{ILL}$ represents the acoustic path between the left loudspeaker of the second pair 34 and the left ear of the user 22; the second transfer function $H_{ILR}$ represents the acoustic path between the left loudspeaker of the second pair 34 and the right ear of the user 22; the second transfer function $H_{ILR}$ represents the acoustic path between the right loudspeaker of the second pair 34 and the left ear of the user 22; and finally the second transfer function $H_{IRR}$ represents the acoustic path between the right loudspeaker of the second pair 34 and the right ear of the user 22.

The determination module 44 is typically configured to obtain the first transfer functions $h_{SLL}$, $h_{SLR}$, $h_{SRL}$, $h_{SRR}$ and the respectively second transfer functions $h_{ILL}$, $h_{ILR}$, $h_{IRL}$, $h_{IRR}$ in the time domain, then to convert each time domain transfer function $h_{SLL}$, $h_{SLR}$, $h_{SR}L$, $h_{SRR}$, $h_{ILL}$, $h_{ILR}$, $h_{IRL}$, $h_{IRR}$ to a respective frequency domain transfer function $H_{SLL}$, $H_{SLR}$, $H_{SRL}$, $H_{SRR}$, $H_{ILL}$, $H_{ILR}$, $H_{IRL}$, $H_{IRR}$. The conversion from the time domain to the frequency domain is performed via application of a Fourier Transform, for example, such as a Local Fourier Transform, to each respective $h_{SLL}$, $h_{SLR}$, $h_{SRL}$, $h_{SRR}$, $h_{ILL}$, $h_{ILR}$, $h_{IRL}$, $h_{IRR}$ transfer function.

The determination module 44 is configured to obtain the first transfer functions $h_{SLL}$, $h_{SLR}$, $h_{SRL}$, $h_{SRR}$ and the respectively second transfer functions $h_{ILL}$, $h_{ILR}$, $h_{IRL}$, $h_{IRR}$ in the time domain, by prior measurement of each transfer function, for example, or by acquisition of each transfer function from a corresponding database, not shown.

Additionally, the determination module 44 is configured to determine each respective crosstalk reduction filter $G_{ILL}$, $G_{ILR}$, $G_{IRL}$, $G_{IRR}$ in the frequency domain, with the calculation module 46 then being configured to calculate each corrective signal $C_L$, $C_R$ in the frequency domain.

Each respective crosstalk reduction filter $G_{ILL}$, $G_{ILR}$, $G_{IRL}$, $G_{IRR}$ is typically obtained from at least one respective second transfer function $H_{ILL}$, $H_{ILR}$, $H_{IRL}$, $H_{IRR}$ and at least one respective inverse filter $J_{SLL}$, $J_{SLR}$, $J_{SRL}$, $J_{SRR}$, each respective inverse filter $J_{SLL}$, $J_{SLR}$, $J_{SRL}$, $J_{SRR}$ being obtained by inverting at least one first transfer function $H_{SLL}$, $H_{SLR}$, $H_{SRL}$, $H_{SRR}$.

To determine each respective inverse filter $J_{SLL}$, $J_{SLR}$, $J_{SRL}$, $J_{SRR}$, the determination module 44 is preferably configured to aggregate the first transfer functions $H_{SLL}$, $H_{SLR}$, $H_{SRL}$, $H_{SRR}$ into a first global transfer matrix $H_S$ representing of all acoustic paths between the loudspeakers 35 of the first pair 32 and the ears of the user 22 according to the following equation, for example:

$$H_S(z) = \begin{bmatrix} H_{SLL}(z) & H_{SRL}(z) \\ H_{SLR}(z) & H_{SRR}(z) \end{bmatrix} \quad \text{[Eq. 1]}$$

where $H_S$ represents the first global transfer matrix, and $H_{SLL}$, $H_{SRL}$, $H_{SLR}$, $H_{SRR}$ represent the first transfer functions.

The determination module 44 is then preferably configured to invert the first global transfer matrix $H_S(z)$ to obtain each respective inverse filter $J_{SLL}$, $J_{SLR}$, $J_{SRL}$, $J_{SRR}$ according to the following equation, for example:

$$H_S^{-1}(z) = \begin{bmatrix} J_{SLL}(z) & J_{SRL}(z) \\ J_{SLR}(z) & J_{SRR}(z) \end{bmatrix} \quad \text{[Eq. 2]}$$

where $H_S^{-1}(z)$ represents the inverse of the first global transfer matrix, and $J_{SLL}$, $J_{SRL}$, $J_{SLR}$, $J_{SRR}$ represent the respective inverse filters.

Additionally, for the inversion of at least a first transfer function $H_{SLL}$, $H_{SLR}$, $H_{SRL}$, $H_{SRR}$, the determination module 44 is configured to add a regularization term β to the denominator of a fraction representing said inversion.

For example, the determination module 44 is configured to add the regularization term β to the denominator of said fraction, according to the following equation:

$$H_S^{-1}(z)=(H_S^H(z)\cdot H_S(z)+\beta(z)I_2)^{-1}H_S^H(z) \quad \text{[Eq. 3]}$$

where $H_S^{-1}(z)$ represents the inverse of the first global transfer matrix, $H_S^H(z)$ represents the complex conjugate matrix of the first global transfer matrix $H_S(z)$, $\beta(z)$ represents the regularization term, $I_2$ represents the identity matrix of a 2×2 dimension according to the following equation:

$$I_2 = \begin{bmatrix} 1 & 0 \\ 0 & 1 \end{bmatrix}$$

The equation (3) for inversion of the first global transfer matrix is then typically rewritten as follows:

$$H_S^{-1}(z)=D(z)\cdot H_S^H(z) \quad \text{[Eq.4]}$$

where D(z) is an inversion matrix satisfying the following equation:

$$D(z)=(H_S^H(z)\cdot H_S(z)+\beta(z)I_2)^{-1} \quad \text{[Eq. 5]}$$

and by convention written in the following form:

$$D(z) = \begin{bmatrix} D_{SLL}(z) & D_{SRL}(z) \\ D_{SLR}(z) & D_{SRR}(z) \end{bmatrix} \quad \text{[Eq. 6]}$$

According to the complement where each respective crosstalk reduction filter $G_{ILL}$, $G_{ILR}$, $G_{IRL}$, $G_{IRR}$ is determined in the frequency domain, the regularization term β is frequency dependent, that is, it is a regularization function that depends on the frequency. The regularization term β preferably has a minimum constant value for a predetermined range of frequencies and a value tending to infinity outside said range.

Figure 2:
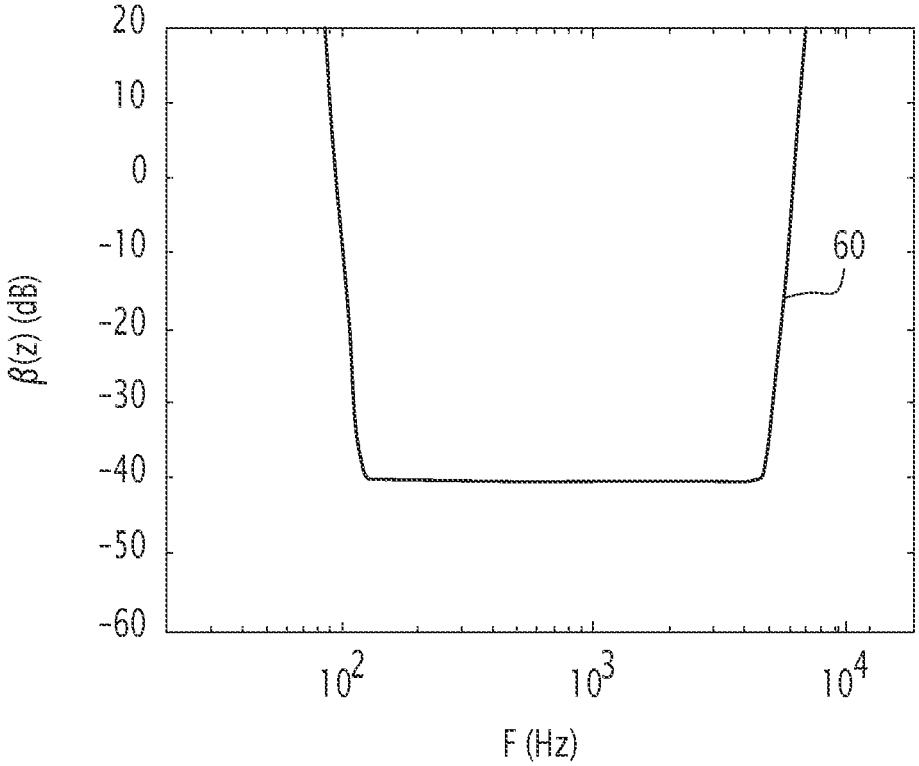
FIG. 2 illustrates two examples of a regularization term used for the inversion of a transfer function, for determining each respective crosstalk reduction filter.
Figure 2:
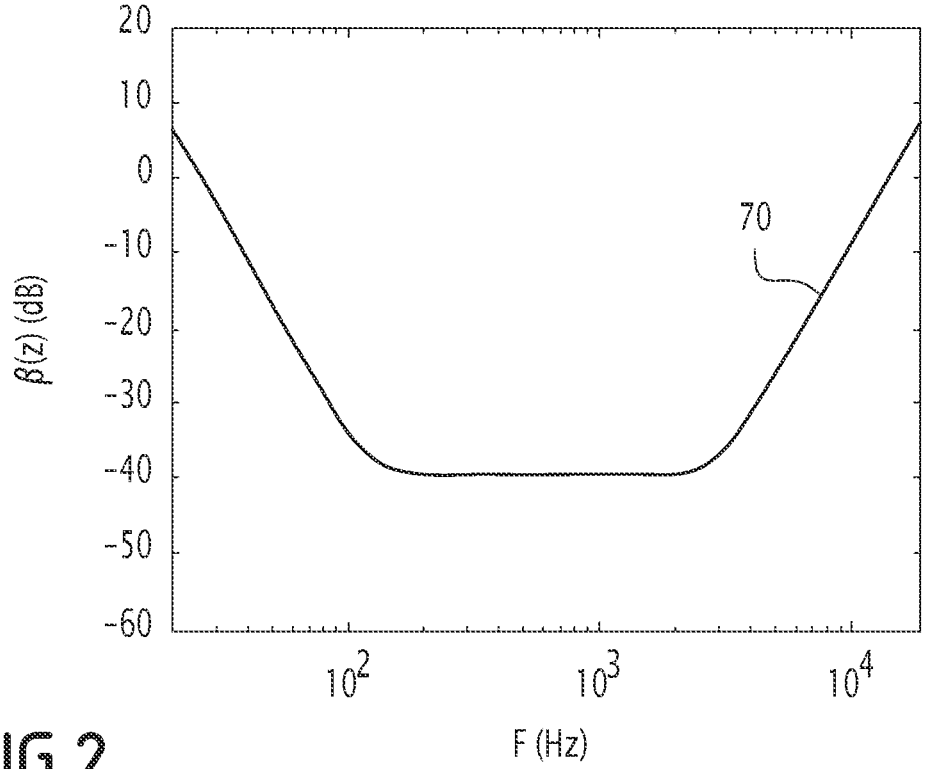

In FIG. 2, two examples of the regularization term β are illustrated via respective first 60 and second 70 curves. For each of the first and second curves, 60 and 70, the minimum constant value is substantially equal to −40 dB, and the predetermined range of frequencies is substantially between 100 Hz and 5 kHz. For the first curve 60, the value of the regularization term β(z) tends more rapidly toward infinity outside of said predetermined frequency range than for the second curve 70.

In a variant, the minimum value of the regularization term β(z) depends on a sliding average of the equation denominator (3). According to this embodiment, the determination module 44 is configured to calculate the sliding average of each term of the matrix $H_S^H(z)\cdot H_S(z)$ over a neighborhood of each frequency, that is, each sampled frequency, for the predetermined range of frequencies, and then to multiply this sliding average by a constant value to obtain the regularization term 3(*z*) within the predetermined range of frequencies. Outside the predetermined range of frequencies, the value of the regularization term 3(*z*) tends to infinity, similar to what was described in the previous examples in FIG. 2.

According to the equation (4) combined with equations (2), (6) and (1), the determination module 44 is configured to invert each respective inverse filter $J_{SLL}$, $J_{SLR}$, $J_{SRL}$, $J_{SRR}$ according to the following equation:

$$\begin{bmatrix} J_{SLL}(z) & J_{SRL}(z) \\ J_{SLR}(z) & J_{SRR}(z) \end{bmatrix} = \begin{bmatrix} D_{SLL}(z) & D_{SRL}(z) \\ D_{SLR}(z) & D_{SRR}(z) \end{bmatrix} \begin{bmatrix} H^*_{SLL}(z) & H^*_{SLR}(z) \\ H^*_{SRL}(z) & H^*_{SRR}(z) \end{bmatrix} \quad \text{[Eq. 7]}$$

or also according to the following set of equations:

$$J_{SLL}(z)=D_{SLL}(z)\cdot H_{SLL}(z)+D_{SRL}(z)\cdot H_{SRL}(z)$$

$$J_{SRL}(z)=D_{SLL}(z)\cdot H^*_{SLR}(z)+D_{SRL}(z)\cdot H^*_{SRR}(z)$$

$$J_{SLR}(z)=D_{SLR}(z)\cdot H^*_{SLL}(z)+D_{SRR}(z)\cdot H_{SRL}(z)$$

$$J_{SRR}(z)=D_{SLR}(z)\cdot H^*_{SLR}(z)+D_{SRR}(z)\cdot H^*_{SRR}(z) \quad \text{[Eq. 8]}$$

To obtain each respective crosstalk reduction filter $G_{ILL}$, $G_{ILR}$, $G_{IRL}$, $G_I$RR, the determination module 44 is preferably configured to aggregate the second transfer functions $H_{ILL}$, $H_{ILR}$, $H_{IRL}$, $H_{IRR}$ into a second global transfer matrix $H_I$ representing all acoustic paths between the loudspeakers 35 of the second pair 34 and the ears of the user 22, according to the following equation, for example:

$$H_I(z) = \begin{bmatrix} H_{ILL}(z) & H_{IRL}(z) \\ H_{ILR}(z) & H_{IRR}(z) \end{bmatrix} \quad \text{[Eq. 9]}$$

where $H_I$ represents the second global transfer matrix, and $H_{ILL}$, $H_{IRL}$, $H_{ILR}$, $H_{IRR}$ represent the second transfer functions.

The determination module 44 is also preferably configured to aggregate the crosstalk reduction filters $G_{ILL}$, $G_{ILR}$, $G_{IRL}$, $G_{IRR}$ into an overall crosstalk reduction matrix G representing all crosstalk reductions to the ears of the user 22 resulting from the loudspeakers 35 of the second pair 34 according to the following equation, for example:

$$G(z) = \begin{bmatrix} G_{ILL}(z) & G_{IRL}(z) \\ G_{ILR}(z) & G_{IRR}(z) \end{bmatrix} \quad \text{[Eq. 10]}$$

where G represents the global crosstalk reduction matrix, and $G_{ILL}$, $G_{ILR}$, $G_{IRL}$, $G_{IRR}$ represent the crosstalk reduction filters.

The determination module 44 is then configured to determine the global crosstalk reduction matrix G according to the following equation, for example:

$$G(z)=-H_S^{-1}(z)\cdot H_1(z) \quad \text{[Eq. 11]}$$

According to the equation (11) combined with equations (10), (2) and (9), the determination module 44 is to determine the crosstalk reduction filters $G_{ILL}$, $G_{ILR}$, $G_{IRL}$, $G_{IR}$R according to the following set of equations:

$$G_{ILL}(z)=-J_{SLL}(z)\cdot H_{ILL}(z)-SRL(z)\cdot H_{ILR}(z)$$

$$G_{IRL}(z)=-J_{SLL}(z)\cdot H_{IRL}(z)-J_{SRL}(z)\cdot H_{IRR}(z)$$

$$G_{ILR}(z)=-J_{SRR}(z)\cdot H_{ILR}(z)-J_{SLR}(z)\cdot H_{ILL}(z)$$

$$G_{IRR}(z)=-J_{SRR}(z)\cdot H_{IRR}(z)-J_{SLR}(z)\cdot H_{IRL}(z) \quad \text{[Eq. 12]}$$

where $G_{ILL}$, $G_{IRL}$, $G_{ILR}$, $G_{IRR}$ represent the crosstalk reduction filters, $H_{ILL}$, $H_{IRL}$, $H_{ILR}$, $H_{IRR}$ represent the respective second transfer functions, and $J_{SLL}$, $J_{SRL}$, $J_{SLR}$, $J_{SRR}$ represent the respective inverse filters.

The calculation module 46 is configured to compute the respective right $C_R$, and left $C_L$ corrective signal by applying the respective right $G_{ILR}$, $G_{IRR}$, and left $G_{ILL}$, $G_{IRL}$ crosstalk reduction filters to the second audio signals $Y_{IL}$, $Y_{IR}$. More precisely, the right corrective signal $C_R$ is obtained by applying the right crosstalk reduction filters $G_{ILR}$, $G_{IRR}$ to the second audio signals $Y_{IL}$, $Y_{IR}$, and the left corrective signal $C_L$ is obtained by applying the left crosstalk reduction filters $G_{ILR}$, $G_{IRR}$ to the second audio signals $Y_{IL}$, $Y_{IR}$.

The calculation module 46 is then configured to calculate the corrective signals according to the following equations:

$$C_L(z)=G_{ILL}(z)\cdot Y_{IL}(z)+G_{IRL}(z)\cdot Y_{IR}(z) \quad \text{[Eq.13]}$$

$$C_R(z)=G_{ILR}(z)\cdot Y_{IL}(z)+G_{IRR}(z)\cdot Y_{IR}(z) \quad \text{[Eq. 14]}$$

where $C_L$, $C_R$ represent the respective left and right corrective signals, $G_{ILL}$, $G_{IRL}$, $G_{ILR}$, $G_{IRR}$ represent the crosstalk reduction filters, and $Y_{IL}$, $Y_{IR}$ represent the respective left and right second audio signals.

The generation module 48 is then configured to generate the respective first right and left corrected audio signal $V_R$, from the respective first audio signal $X_{SR}$, $X_{SL}$ and the corresponding corrective signal $C_L$, $C_R$.

Each first corrected audio signal $V_R$, $V_L$ is typically the sum of the respective first audio signal $X_{SR}$, $X_{SL}$ and the corresponding corrective signal $C_L$, $C_R$.

The generation module 48 is then configured to generate the first corrected audio signals $V_R$, $V_L$ according to the following equation, for example:

$$V(z)=X_S(z)+C(z) \quad \text{[Eq.15]}$$

where a matrix V of corrected audio signals satisfies:

$$V(z) = \begin{bmatrix} V_L(z) \\ V_R(z) \end{bmatrix} \quad \text{[Eq. 16]}$$

a matrix $X_S$ of first audio signals satisfies:

$$X_S(z) = \begin{bmatrix} X_{S_L}(z) \\ X_{S_R}(z) \end{bmatrix} \quad \text{[Eq. 17]}$$

and a matrix C of corrective signals satisfies:

$$C(z)=\begin{bmatrix} C_L(z) \\ C_R(z) \end{bmatrix} \quad \text{[Eq. 18]}$$

The generation module 48 is then configured to convert each first corrected audio signal $V_R$, $V_L$ in the frequency domain into a respective first corrected audio signal $V_R$, $V_L$ in the time domain by application of an inverse Fourier Transform, for example, such as an inverse Local Fourier Transform, also known as an inverse Short-Time Fourier Transform, or also known as an inverse sliding window Fourier Transform.

The respective first right corrected audio signal $v_R$, and first left corrected audio signal $v_L$ in the time domain are then intended to be broadcast via the respective right and left loudspeaker 35 of the first pair 32 while the second right $y_{IR}$ and left $y_{IL}$ audio signals are being broadcast via the right and left loudspeakers 35 of the second pair 34.

Figure 3:
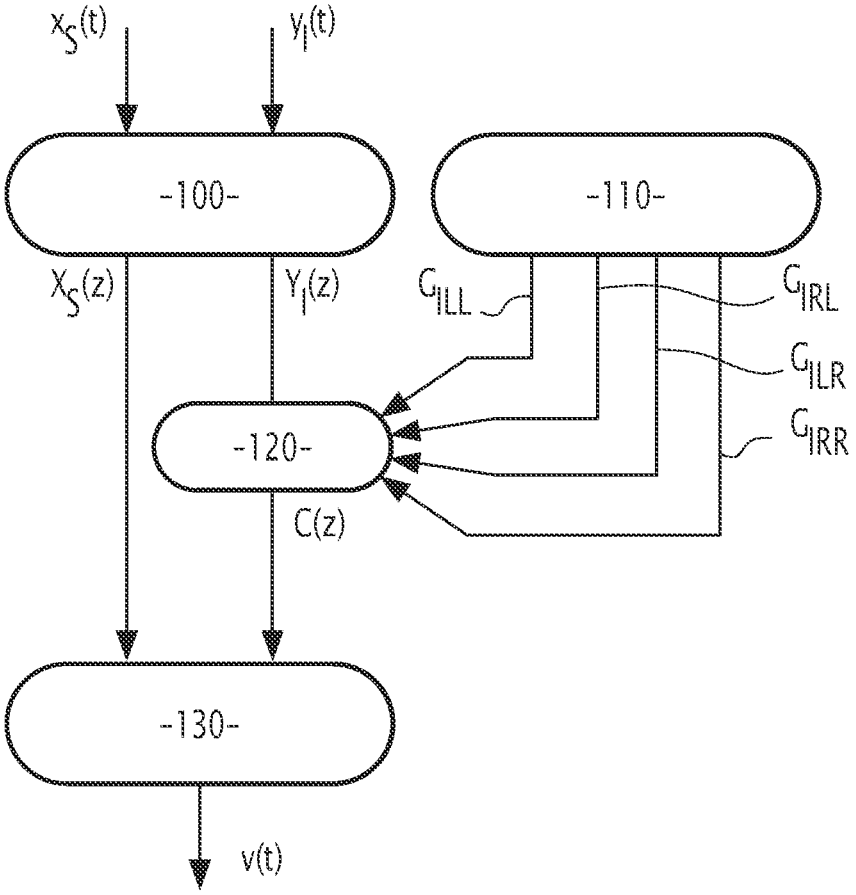
FIG. 3 is a flow chart of a method for reducing crosstalk according to an embodiment of the invention, the method being implemented by each electronic crosstalk reduction device, comprising a step of acquiring the first and second right and left audio signals, a step of determining the crosstalk reduction filters, a step of calculating the right and left corrective signals by applying the crosstalk reduction filters to the second audio signals, and a step of generating the first corrected right and left signals to be broadcast via the loudspeakers of the first pair, while broadcasting the second audio signals via the loudspeakers of the second pair.
Figure 4:
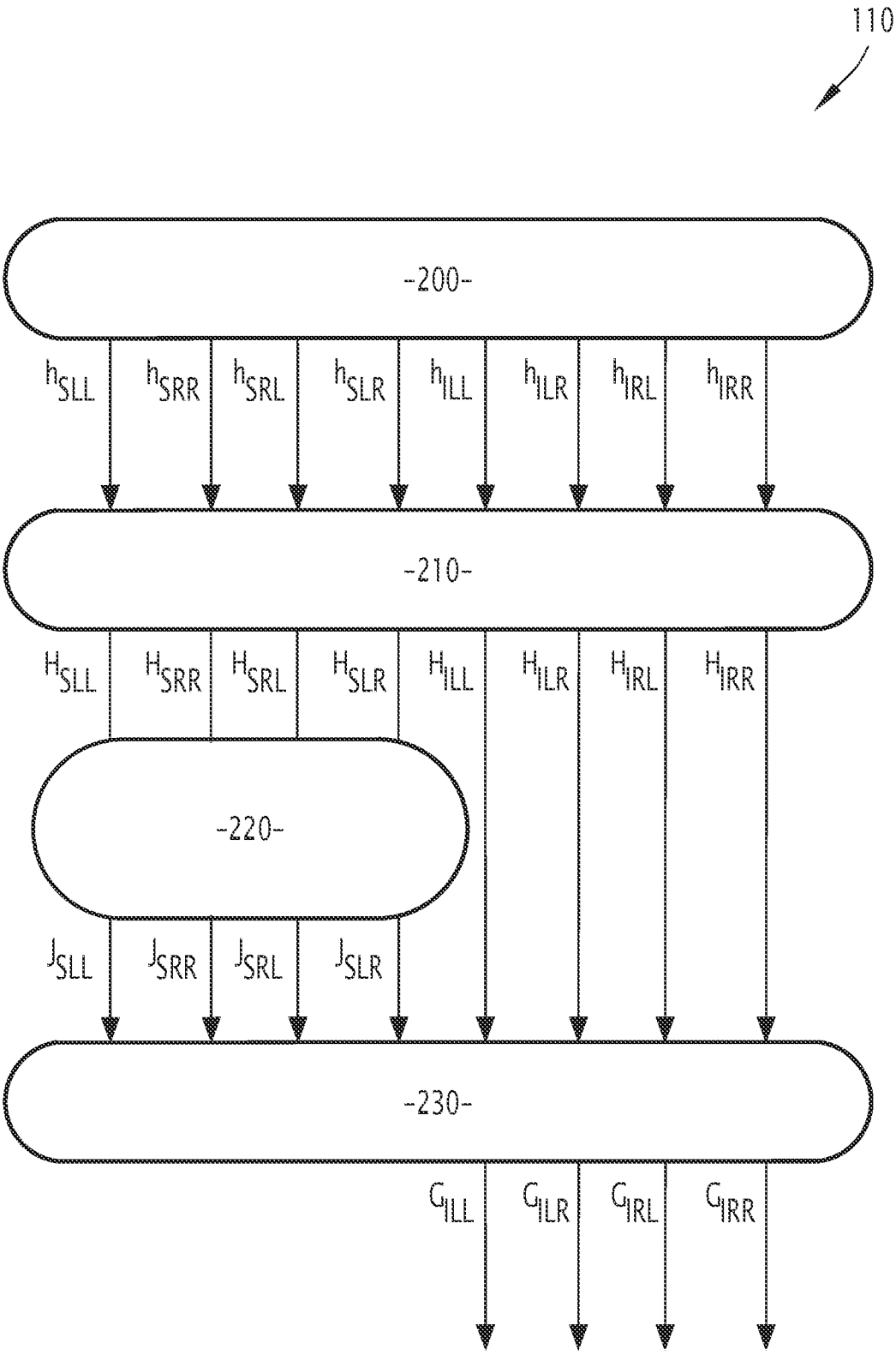
FIG. 4 is a more detailed flowchart of the step of determining the crosstalk reduction filters of the flowchart of FIG. 3.

The operation of the audio system 10 for seat headrests 12 and in particular of the electronic crosstalk reduction device 40 will now be described with reference to FIGS. 3 and 4 representing a flow chart of the crosstalk reduction process, the process being implemented by the electronic crosstalk reduction device 40.

In an initial step 100, visible in FIG. 3, the crosstalk reduction device 40 acquires the first right and left $x_s$ audio signals, via its acquisition module 42, and the respective second right and left $y_I$ audio signals, in the time domain.

As an optional addition, in the acquisition step 100, the acquisition module 42 converts the signals acquired, that is, the first right and left $x_s$ audio signals and respective second right and left $y_I$ audio signals, from the time domain into first right and left $x_s$ audio signals, and into respective second right and left audio signals $Y_i$ in the frequency domain, typically by application of a respective Fourier Transform, such as a local Fourier Transform, to each acquired audio signal.

In step 110, via its determination module 44, the crosstalk reduction device 40 determines, two right crosstalk reduction filters $G_{ILR}$, $G_{IRR}$, and respective two left crosstalk reduction filters $G_{ILL}$, $G_{IRL}$, each of which is capable of reducing the crosstalk resulting from a respective loudspeaker 35 of the second pair 34 for the respective ear of the user 22.

The determination step 110, performed by the determination module 44, is shown in more detail in FIG. 4, and includes an initial sub-step 200 of obtaining the first transfer functions $h_{SLL}$, $h_{SLR}$, $h_{SRL}$, $h_{SRR}$, and respective second transfer functions $h_{ILL}$, $h_{ILR}$, $h_{IRL}$, $h_{IRR}$, in the time domain.

The determination module 44 then proceeds to sub-step 210, in which it converts each obtained transfer function $h_{SLL}$, $h_{SLR}$, $h_{SRL}$, $h_{SRR}$, $h_{ILL}$, $h_{ILR}$, $h_{IRL}$, $h_{IRR}$ from the time domain to a transfer function $h_{SLL}$, $h_{SLR}$, $h_{SRL}$, $h_{SRR}$, $h_{ILL}$, $h_{ILR}$, $h_{IRL}$, $h_{IRR}$ in the frequency domain, typically by application of a Fourier Transform, such as a Local Fourier Transform, to each respective $h_{SLL}$, $h_{SLR}$, $h_{SRL}$, $h_{SRR}$, $h_{ILL}$, $h_{ILR}$, $h_{IRL}$, $h_{IRR}$ transfer function.

In the next sub-step 220, the determination module 44 obtains each respective inverse filter $J_{SLL}$, $J_{SLR}$, $J_{SRL}$, $J_{SRR}$ by inverting at least a first transfer function $H_{SLL}$, $H_{SLR}$, $H_{SRL}$, $H_{SRR}$.

The determination of each respective inverse filter $J_{SLL}$, $J_{SLR}$, $J_{SRL}$, $J_{SRR}$ is performed according to equation (7), for example, resulting in the set (8) of equations.

The determination module 44 finally proceeds to sub-step 230, in which it determines each respective crosstalk reduction filter $G_{ILL}$, $G_{ILR}$, $G_{IRL}$, $G_{IRR}$, typically from at least one respective second transfer function $H_{ILL}$, $H_{ILR}$, $H_{IRL}$, $H_{IRR}$ and at least one respective inverse filter $J_{SLL}$, $J_{SLR}$, $J_{SRL}$, $J_{SRR}$.

The determination of each respective crosstalk reduction filter $G_{ILL}$, $G_{ILR}$, $G_{IRL}$, $G_{IRR}$ is performed according to the set (12) of equations, resulting from equation (11) combined with equations (10), (2) and (9), for example.

At the end of the determination step 110, the crosstalk reduction device 40 then proceeds to the step 120, visible in FIG. 3, during which it calculates the respective right $C_R$ and left $C_L$ corrective signal, via its calculation module 46, by applying the respective right $G_{ILR}$, $G_{IRR}$, and left $G_{ILL}$, $G_{IRL}$, crosstalk reduction filters to the second audio signals $Y_{IL}$, $Y_{IR}$.

The calculation of the right corrective signal $C_R$ and respective left corrective signal $C_L$ is performed according to equation (14) and according to equation (13) respectively, for example.

In the next step 130 and via its generation module 48, the crosstalk reduction device 40 finally generates the first corrected right audio signal VR and respective left audio signal $V_L$ from the respective first audio signal $X_{SR}$, $X_{SL}$ and the corresponding corrective signal $C_L$, $C_R$.

Each first corrected audio signal $V_R$, $V_L$ is typically the sum of the respective first audio signal $X_{SR}$, $X_{SL}$ and the corresponding corrective signal $C_L$, $C_R$.

The generation of the first corrected audio signals $V_R$, $V_L$ is performed according to equation (15), for example.

When, as an optional addition, the determination 110 and calculation 120 steps have been performed in the frequency domain, the generation module 48 further converts each first corrected audio signal $V_R$, $V_L$ from the frequency domain into a respective first corrected audio signal $v_R$, $v_L$ in the time domain by application of an inverse Fourier Transform, such as a local inverse Fourier Transform, for example.

Thus, when the first corrected right $v_R$ and respective left $v_L$ audio signal in the time domain is broadcast via the respective right and left loudspeaker 35 of the first pair 32, while the second right $y_{IR}$ and left $y_{IL}$ audio signals are being broadcast via the right and left loudspeakers 35 of the second pair 34, the user 22 perceives a right perceived audio signal $e_R$ in his right ear, and a left perceived audio signal $e_L$ in his left ear respectively.

The left perceived audio signal $e_L$ then satisfies the following equation:

$$e_L(t)=v_L(t)*h_{SLL}(t)+V_R(t)+h_{SRL}(t)+Y_{I_L}(t)*h_{ILL}(t)+Y_{IR}(t)*h_{IRL}(t) \quad \text{[Eq. 19]}$$

and the right perceived audio signal $e_R$ satisfies the following equation:

$$e_R(t)=v_R(t)*h_{SRR}(t)+v_L(t)*h_{SLR}(t)+Y_{I_L}(t)*h_{ILR}(\sim+Y_{IR}(t)*h_{IRR}(t) \quad \text{[Eq.20]}$$

Now, given the above, including the determination of each crosstalk reduction filter $G_{ILL}$, $G_{ILR}$, $G_{IRL}$, $G_{IRR}$ and each corrective signal $C_L$, $C_R$, the left perceived audio signal eL then satisfies the following equation:

$$e_L(t)\sim x_{S_L}(t)*h_{SLL}(t)=\tilde{e}_L(t) \quad \text{[Eq. 21]}$$

where $\tilde{e}_L$ represents a left perceived audio signal without crosstalk; and the right perceived audio signal $e_R$ satisfies the following equation:

$$e_R(t)\sim X_{S_R}(t)*h_{SRR}(t)=\tilde{e}R(t) \quad \text{[Eq. 22]}$$

where $\tilde{e}_R$ represents a right perceived audio signal without crosstalk.

The crosstalk reduction device 40 then calculates the crosstalk reduction from the first $H_{SLL}$, $H_{SLR}$, $H_{SRL}$, $H_{SRR}$ and second $H_{ILL}$, $H_{ILR}$, $H_{IRL}$, $H_{IRR}$ predefined transfer functions, where each first transfer function $H_{SLL}$, $H_{SLR}$, $H_{SRL}$, $H_{SRR}$ provides a modeling of the acoustic path between a loudspeaker 35 of the first pair 32 and a respective ear of the user 22, and each second transfer function $H_{ILL}$, $H_{ILR}$, $H_{IRL}$, $H_{IRR}$ provides a modeling of the acoustic path between a loudspeaker 35 of the second pair 34 and a respective ear of the user 22.

Preferably, each respective crosstalk reduction filter $G_{ILL}$, $G_{ILR}$, $G_{IRL}$, $G_{IRR}$ is obtained from at least one respective second transfer function $H_{ILL}$, $H_{ILR}$, $H_{IRL}$, $H_{IRR}$ and at least one respective inverse filter $J_{SLL}$, $J_{SRL}$, $J_{SLR}$, $J_{SRR}$, wherein each respective inverse filter $J_{SLL}$, $J_{SRL}$, $J_{SLR}$, $J_{SRR}$ is obtained by inverting at least a first transfer function $H_{SLL}$, $H_{SLR}$, $H_{SRL}$, $H_{SRR}$, which results in an even better reduction of the crosstalk resulting from the second pair of loudspeakers.

Even more preferably, in said inversion of a respective first transfer function $H_{SLL}$, $H_{SLR}$, $H_{SRL}$, $H_{SRR}$, the regularization term 3 is added to the denominator of the fraction representing said inversion, which results in a better stability of the respective inverse filter $J_{SLL}$, $J_{SRL}$, $J_{SLR}$, $J_{SRR}$, and then further improves the crosstalk reduction.

Figure 5:
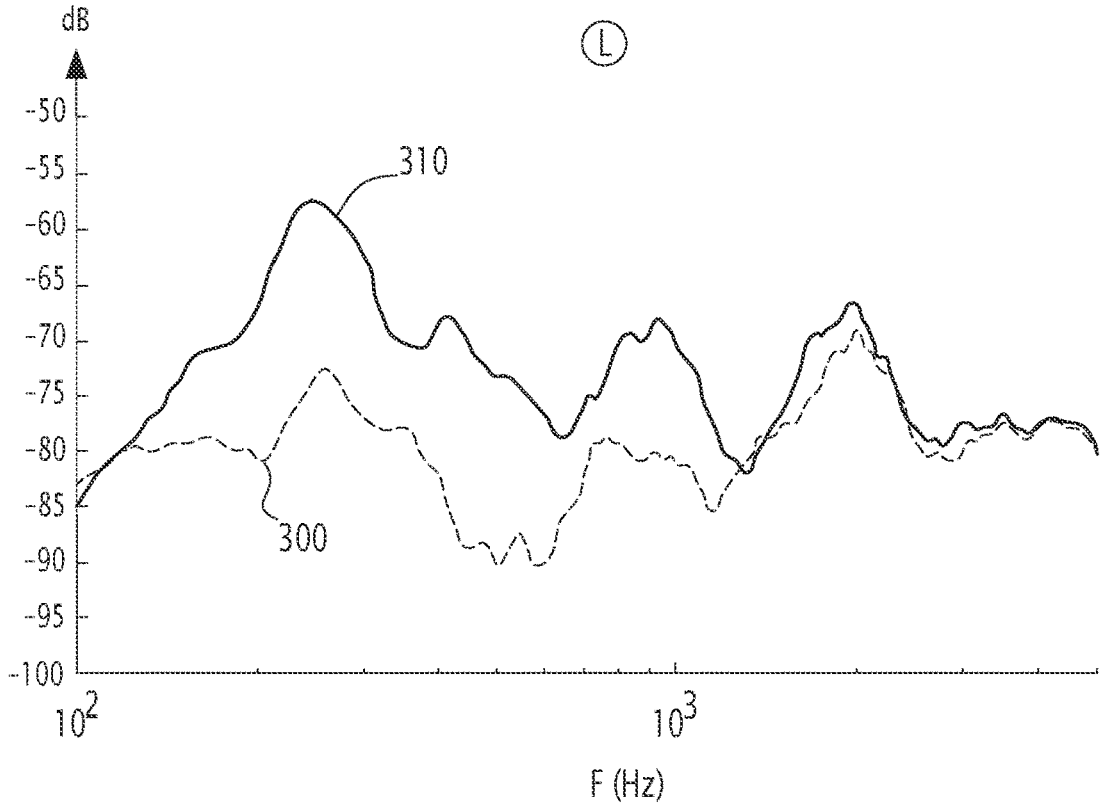
FIG. 5 is a set of curves illustrating a spectrum of a signal perceived by the left ear of a user, on the one hand, depending on whether or not the crosstalk reduction is implemented, and the spectral improvement resulting from implementation of the crosstalk reduction, on the other hand.
Figure 5:
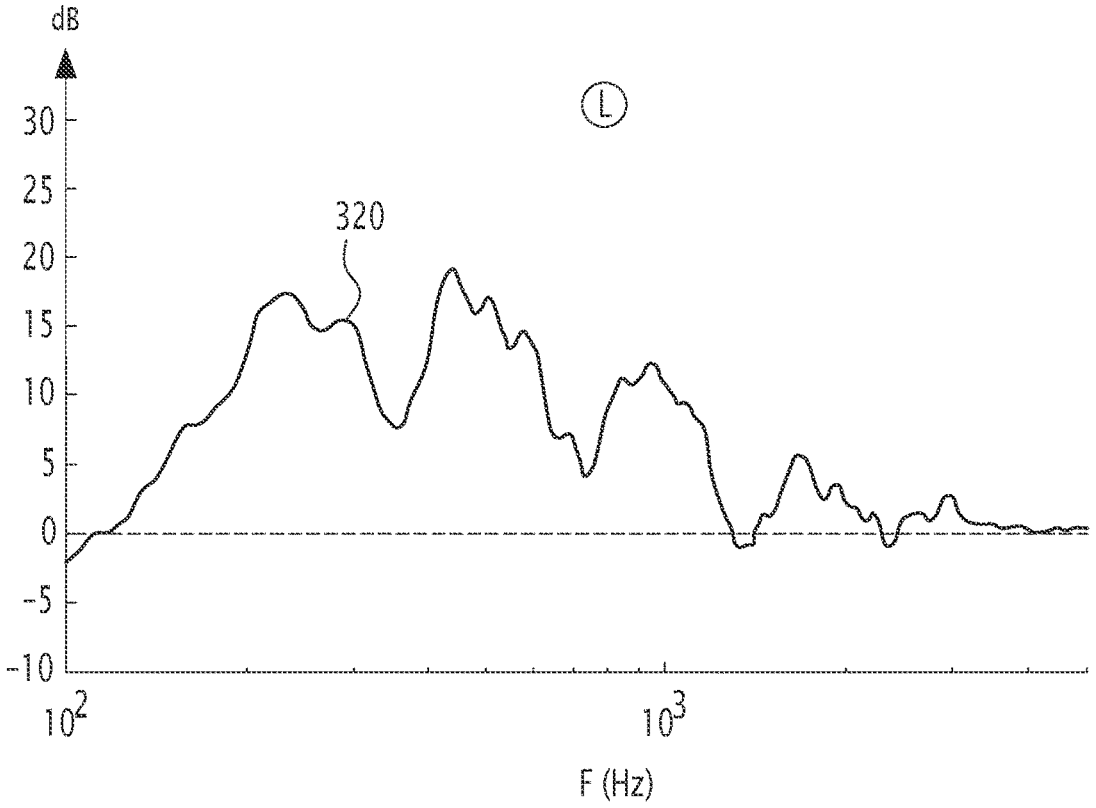
Figure 6:
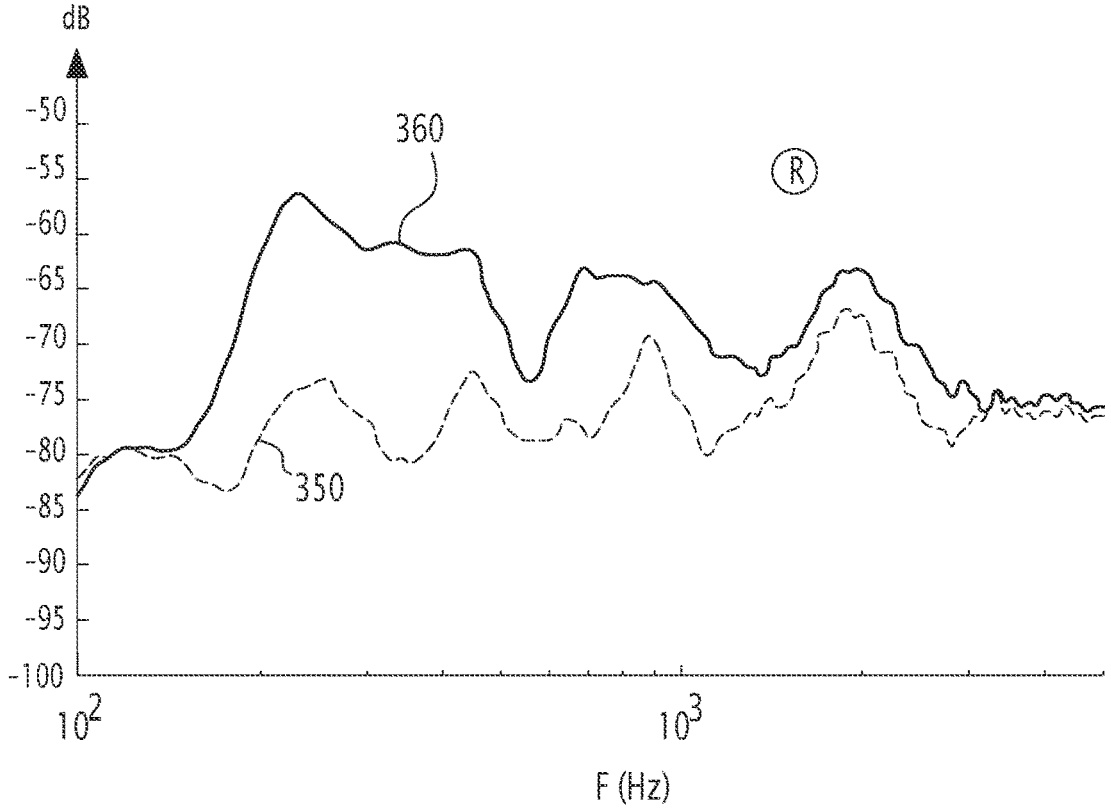
FIG. 6 is a view similar to that of FIG. 5, for the user's right ear.
Figure 6:
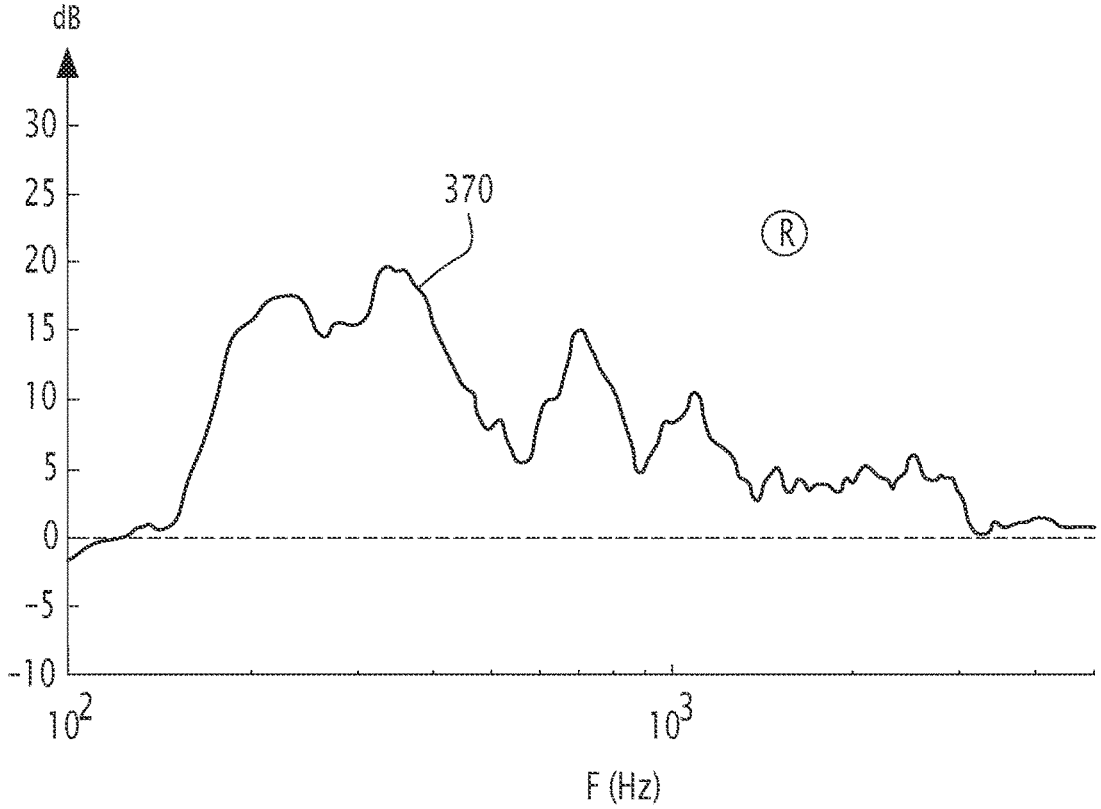
Figure 7:
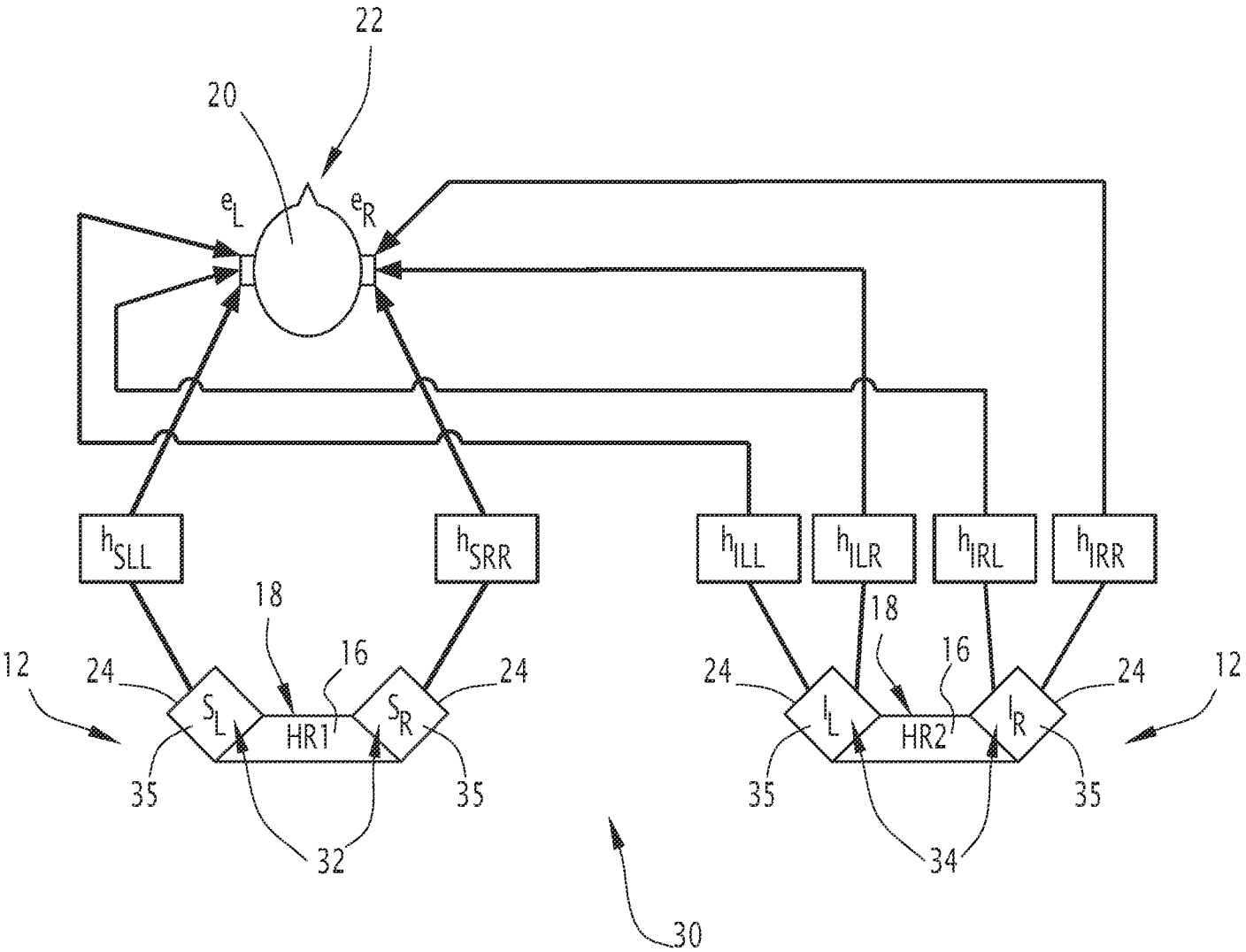
FIG. 7 is a simplified view, similar to that of FIG. 1, according to a second embodiment of the invention.

This calculation for reducing crosstalk is therefore more accurate, and then allows for more effective crosstalk reduction between the loudspeaker pairs 32, 34, as shown in FIG. 5, denoted by the notation L for the left ear and in FIG. 6, denoted by the notation R for the right ear, respectively.

In FIG. 5, a first dashed curve 300 represents the spectrum of the left perceived audio signal $e_L$, that is, the audio signal perceived by the user's left ear 22 when the crosstalk reduction device 40 is operating; and a second solid line curve 310 represents the spectrum of the audio signal perceived by the user's left ear 22 in the absence of crosstalk reduction. Each perceived audio signal spectrum is a curve representing the amplitude, expressed in decibels or dB, of the perceived audio signal as a function of its frequency, expressed in Hertz or Hz.

A third curve 320 then shows the improvement perceived by the user's left ear 22 resulting from implementation of the crosstalk reduction device 40.

In FIG. 6, a fourth dashed curve 350 represents the spectrum of the right perceived audio signal $e_R$, that is, the audio signal perceived by the right ear of the user 22 when the crosstalk reduction device 40 is operating; and a fifth solid curve 360 represents the spectrum of the audio signal perceived by the right ear of the user 22 in the absence of crosstalk reduction. Each perceived audio signal spectrum is a curve representing the amplitude, expressed in decibels or dB, of the perceived audio signal as a function of its frequency, expressed in Hertz or Hz.

A sixth curve 370 then shows the improvement perceived by the user's right ear 22 resulting from implementation of the crosstalk reduction device 40.

The reduction in crosstalk with the crosstalk reduction device 40 is then particularly noticeable up to about 3 kHz, with an improvement of up to 20 dB for each ear of the user 22.

FIGS. 7 to 10 illustrate a second embodiment of the invention in which elements analogous to the first embodiment, described above, are marked by identical references, and are therefore not described again.

According to the second embodiment, the modeling of the acoustic paths between the loudspeakers 35 of the first pair 32 and the ears of the user 22 is simplified by considering that the left ear of the user 22 essentially perceives the audio signal $x_{SL}$ from the left loudspeaker of the first pair 32, and, respectively, the right ear of the user 22 essentially perceives the audio signal $x_{SR}$ from the right loudspeaker of the first pair 32.

In other words, according to the second embodiment, the first transfer function $H_{SRL}$ representing the acoustic path between the right loudspeaker of the first pair 32 and the left ear of the user 22, and the first transfer function $H_{SLR}$ representing the acoustic path between the left loudspeaker of the first pair 32 and the right ear of the user 22 are assumed to be zero.

In other words, of the first transfer functions $H_{SLL}$, $H_{SLR}$, $H_{SRL}$, $H_{SRR}$, only the first transfer function $H_{SLL}$ representing the acoustic path between the left loudspeaker of the first pair 32 and the left ear of the user 22 and the first transfer function $H_{SRR}$ representing the acoustic path between the right loudspeaker of the first pair 32 and the right ear of the user 22 are considered, and the first transfer functions $H_{SLR}$, $H_{SRL}$ are ignored.

According to the second embodiment, the determination module 44 is then preferably configured to aggregate the first transfer functions $H_{SLL}$, $H_{SRR}$ into the first global transfer matrix $H_S$, representing the acoustic paths between the loudspeakers 35 of the first pair 32 and the ears of the user 22, according to the following equation:

$$H_S(z) = \begin{bmatrix} H_{SLL}(z) & 0 \\ 0 & H_{SRR}(z) \end{bmatrix} \quad \text{[Eq. 23]}$$

where $H_S$ represents the first global transfer matrix, and $H_{SLL}$, $H_{SRR}$ represent the first transfer functions considered according to the second embodiment.

According to the second embodiment, the determination module 44 is then preferably configured to invert the first global transfer matrix $H_S$ (z) to obtain each respective inverse filter $J_{SLL}$, $J_{SRR}$ according to the following equation, for example:

$$H_S^{-1}(z) = \begin{bmatrix} J_{SLL}(z) & 0 \\ 0 & J_{SRR}(z) \end{bmatrix} \quad \text{[Eq. 24]}$$

where $H_S^{-1}(z)$ represents the inverse of the first global transfer matrix, and $J_{SLL}$, $J_{SRR}$ represent the respective inverse filters taken into account according to the second embodiment.

The inversion matrix D(z) is then written by convention as:

$$D(z) = \begin{bmatrix} D_{SLL}(z) & 0 \\ 0 & D_{SRR}(z) \end{bmatrix} \quad \text{[Eq. 25]}$$

According to equation (4), which remains valid for this second embodiment, combined with equations (24), (25) and (23), the determination module 44, according to the second embodiment, is configured to invert each respective inverse filter $J_{SLL}$, $J_{SRR}$ according to the following equation:

$$\begin{bmatrix} J_{SLL}(z) & 0 \\ 0 & J_{SRR}(z) \end{bmatrix} = \begin{bmatrix} D_{SLL}(z) & 0 \\ 0 & D_{SRR}(z) \end{bmatrix} \begin{bmatrix} H^*_{SLL}(z) & 0 \\ 0 & H^*_{SRR}(z) \end{bmatrix} \quad \text{[Eq. 26]}$$

or also according to the following set of equations:

$$J_{SLL}(z)=D_{SLL}(z)\cdot H^*_{SLL}(z)$$

$$J_{SRR}(z)=D_{SRR}(z)\cdot H^*_{SRR}(z) \quad \text{[Eq. 27]}$$

According to equation (11), which remains valid for this second embodiment, combined with equations (9) and (10), which remain valid for this second embodiment, and equation (24), the determination module 44, according to the second embodiment, is configured to determine the crosstalk reduction filters $G_{ILL}$, $G_{ILR}$, $G_{IRL}$, $G_{IRR}$ according to the following set of equations:

$$G_{ILL}(z)=-J_{SLL}(z)\cdot H_{ILL}(z)$$

$$G_{IRL}(z)=-J_{SLL}(z)\cdot H_{IRL}(z)$$

$$G_{ILR}(z)=-J_{SRR}(z)\cdot H_{ILR}(z)$$

$$G_{IRR}(z)=-J_{SRR}(z)\cdot H_{IRR}(z) \quad \text{[Eq. 28]}$$

where $G_{ILL}$, $G_{ILR}$, $G_{IRL}$, $G_{IRR}$ represent the crosstalk reduction filters, $H_{ILL}$, $H_{IRL}$, $H_{ILR}$, $H_{IRR}$ represent the respective second transfer functions, and $J_{SLL}$, $J_{SRR}$ represent the respective inverse filters taken into account according to the second embodiment.

The calculation module 46 is then configured to calculate the right $C_R$ and respectively left $C_L$ corrective signal in a manner similar to that previously described for the first embodiment, with equations (13) and (14) remaining valid for this second embodiment, for example.

The generation module 48 is then configured to generate the first corrected respective right $C_L$ and left $V_L$, audio signal from the respective first $X_{SR}$, $X_{SL}$ audio signal and the corresponding corrective $C_L$, $C_R$ signal, in a manner analogous to that previously described for the first embodiment, with equations (15) to (18) remaining valid for this second embodiment, for example.

The operation of this second embodiment is analogous to that of the first embodiment and is therefore not described again.

Figure 8:
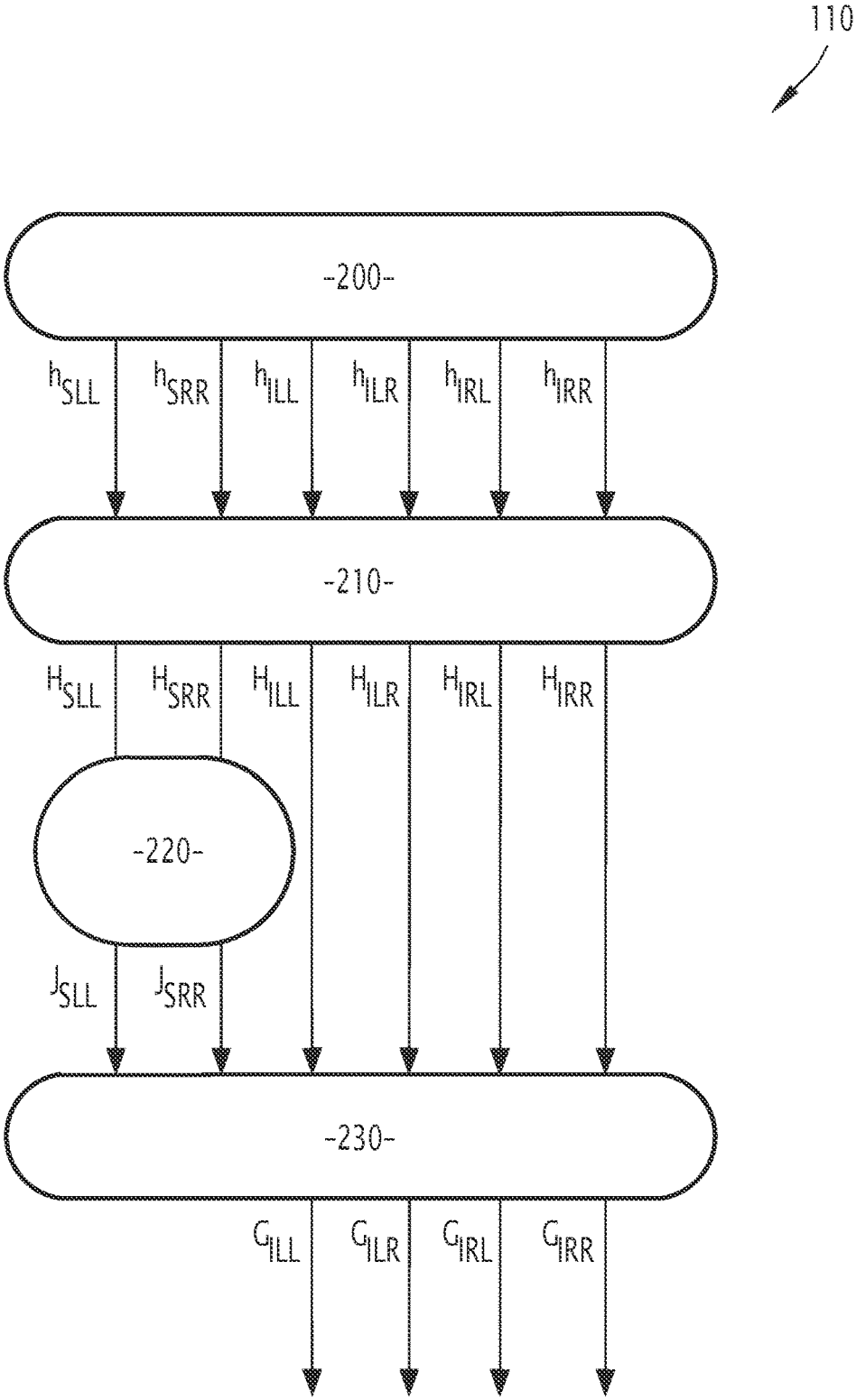
FIG. 8 is a view similar to that of FIG. 4, according to the second embodiment of the invention.

In particular, the person skilled in the art will observe that the flowchart in FIG. 8 representing the determination step 110 is simplified compared to the flowchart in FIG. 4 associated with the first embodiment. Indeed, according to the above, during the sub-step 200, only the first transfer functions $h_{SLL}$, $h_{SRR}$ and the second transfer functions $h_{ILL}$, $h_{ILR}$, $h_{IRL}$, $h_{IRR}$, are obtained in the time domain, the first transfer functions $h_{SLR}$, $h_{SRL}$ not being taken into account. As a result, in the sub-step only the obtained transfer functions $h_{SLL}$, $h_{SLL}$, $h_{SRR}$, $h_{ILL}$, $h_{ILR}$, $h_{IRL}$, $h_{IRR}$ are converted from the time domain into the respective transfer functions $H_{SLL}$, $H_{SRR}$, $H_{ILL}$, $H_{ILR}$, $H_{IRL}$, $H_{IRR}$ in the frequency domain; and in the next sub-step 220, only the inverse filters $J_{SLL}$, $J_{SRR}$ are determined, this by inverting the respective first $H_{SLL}$, $H_{SRR}$ transfer functions taken into account according to the second embodiment. Finally, in sub-step 230, the determination module 44 determines each respective crosstalk reduction filter $G_{ILL}$, $G_{ILR}$, $G_{IRL}$, $G_{IRR}$, typically from at least one respective second transfer function $H_{ILL}$, $H_{ILR}$, $H_{IRL}$, $H_{IRR}$ and at least one respective inverse filter $J_{SLL}$, $J_{SRR}$. The determination of each respective crosstalk reduction filter $G_{ILL}$, $G_{ILR}$, $G_{IRL}$, $G_{IRR}$ is performed according to the set (28) of equations, resulting from equation (11) combined with equations (9), (10) and (24), for example.

The left perceived audio signal $e_L$ then satisfies the following equation:

$$e_L(t)=x_{S_L}(t)*h_{SLL}(t)+Y_{I_L}(t)*h_{ILL}(t)+Y_{I_R}(t)*h_{IRL}(t) \quad [Eq.29]$$

and the right perceived audio signal $e_R$ satisfies the following equation:

$$e_R(t)=X_{S_R}(t)*h_{SRR}(t)+Y_{I_L}(t)*h_{ILR}(t)+Y_{I_R}(t)*h_{IRR}(t) \quad [Eq.30]$$

In view of the above, in particular the determination of each crosstalk reduction filter $G_{ILL}$, $G_{ILR}$, $G_{IRL}$, $G_{IRR}$ and of each corrective signal $C_L$, $C_R$, the left perceived audio signal $e_L$ then satisfies equation (21), and the right perceived audio signal $e_R$ satisfies equation (22), equations (21) and (22) each remaining valid for this second embodiment.

The advantages of this second embodiment are similar to those of the first embodiment and are therefore not described again.

In particular, the crosstalk reduction device 40 according to this second embodiment allows for simpler and then faster calculation of the crosstalk reduction from the first $H_{SLL}$, $H_{SRR}$ and second $H_{ILL}$, $H_{ILR}$, $H_{IRL}$, $H_{IRR}$ predefined transfer functions, where each first $H_{SLL}$ transfer function, $H_{SRR}$ provides a modeling of the acoustic path between a loudspeaker 35 of the first pair 32 and the corresponding ear of the user 22, and each second $H_{ILL}$, $H_{ILR}$, $H_{IRL}$, $H_{IRR}$ transfer function provides a modeling of the acoustic path between a loudspeaker 35 of the second pair 34 and a respective ear of the user 22.

Figure 9:
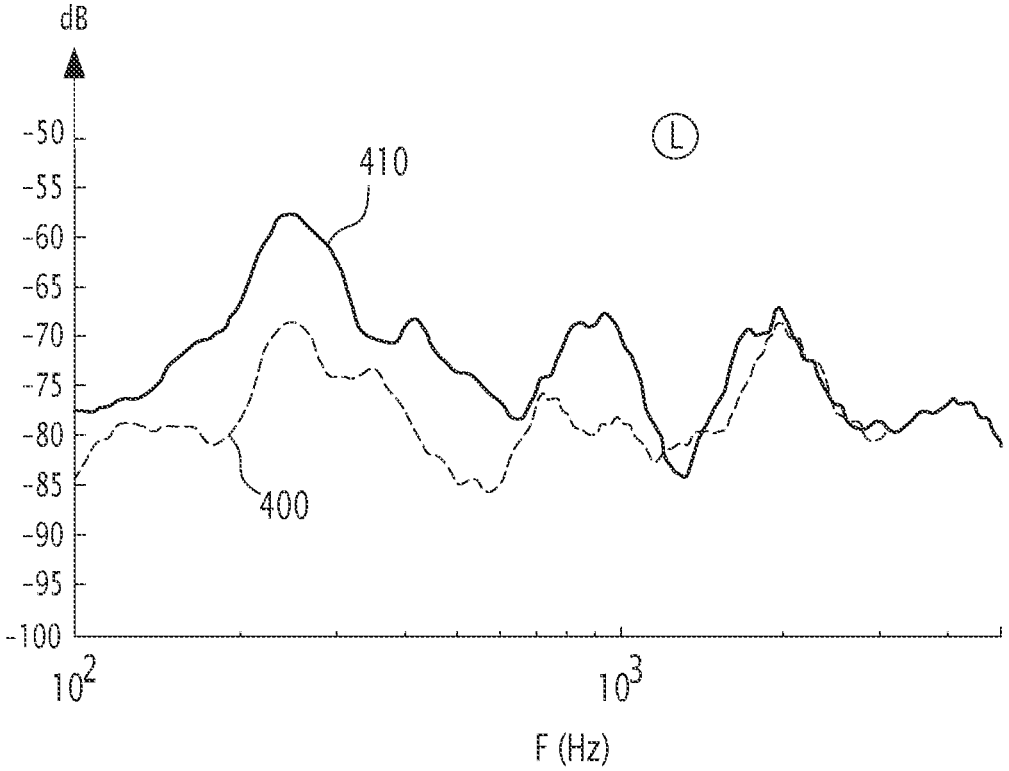
FIG. 9 is a view similar to that of FIG. 5, according to the second embodiment of the invention.
Figure 9:
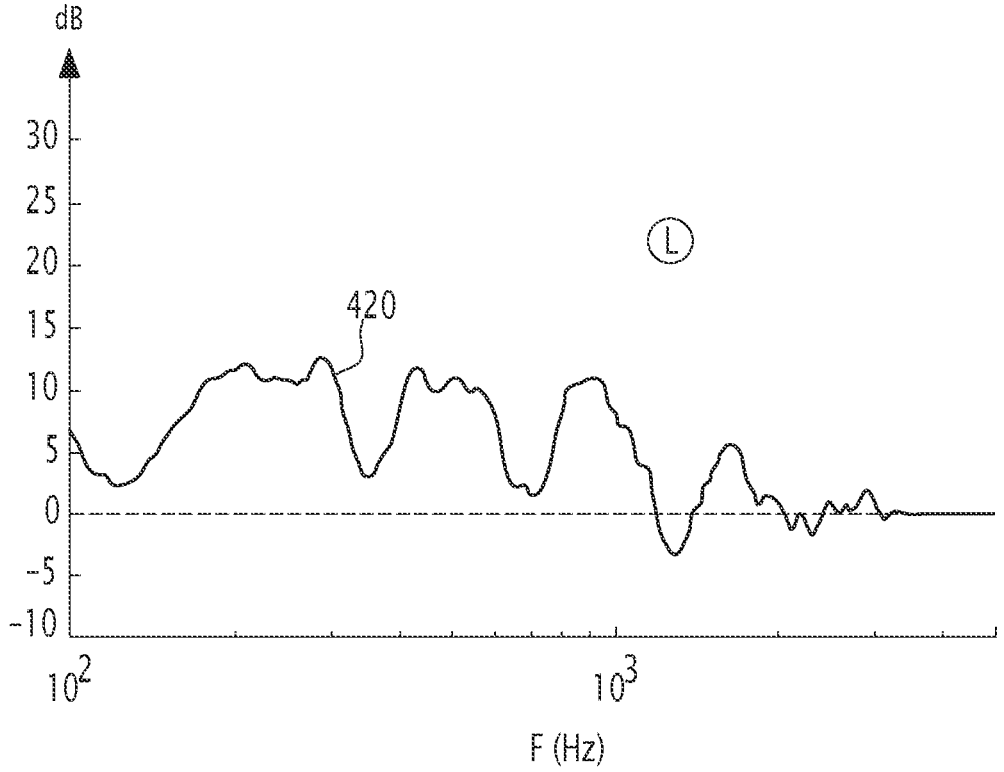
Figure 10:
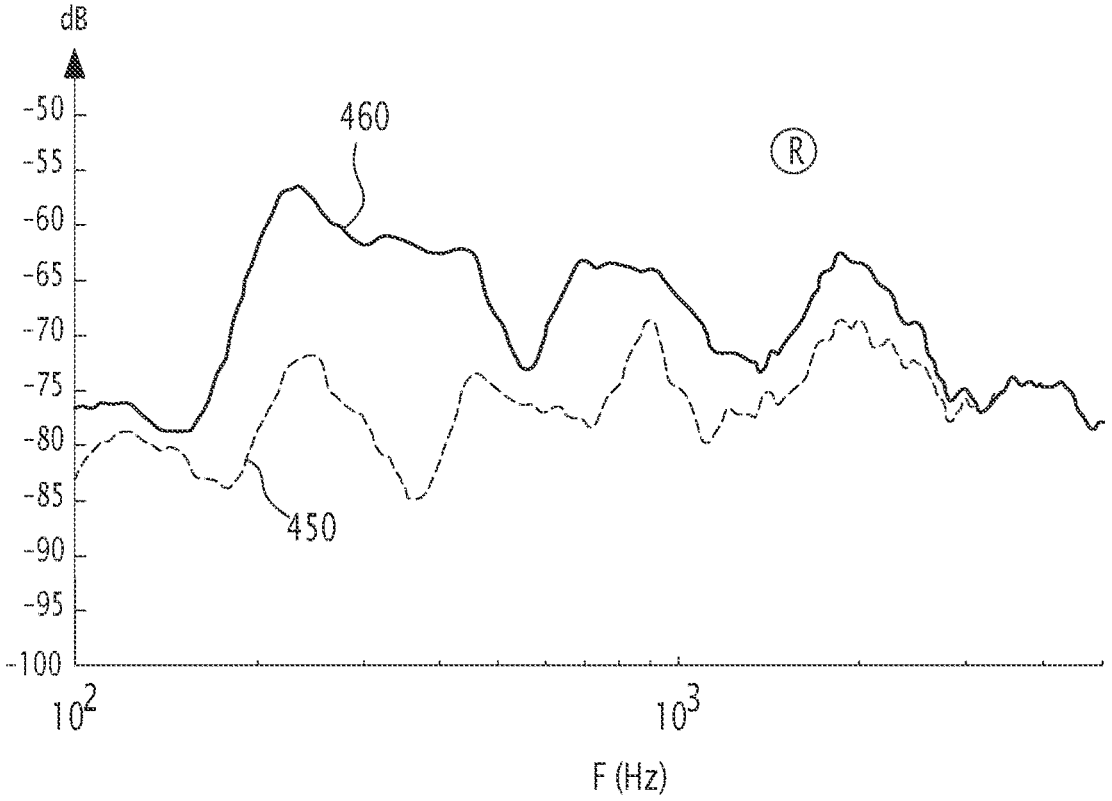
FIG. 10 is a view similar to that of FIG. 6, according to the second embodiment of the invention.
Figure 10:
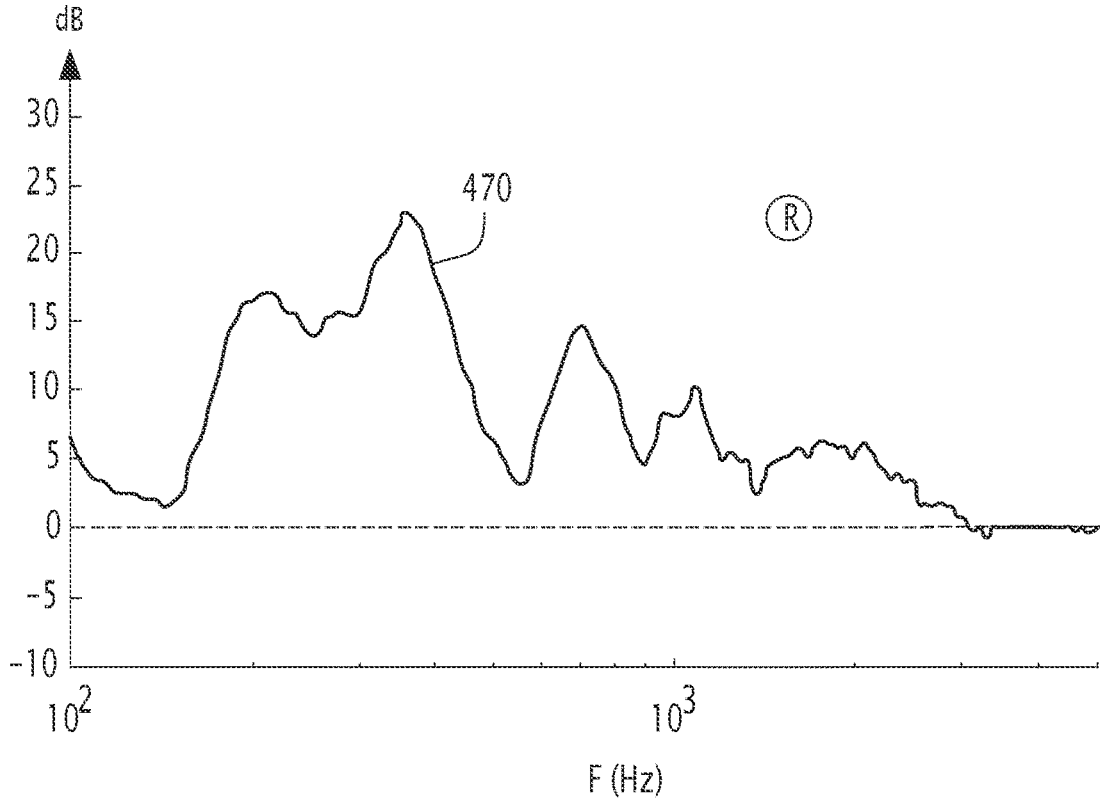

This calculation for reducing crosstalk is therefore faster, yet still accurate, and then provides effective crosstalk reduction between the loudspeaker pairs 32, 34, denoted by the notation L in FIG. 9 for the left ear and denoted by the notation R in FIG. 10 for the right ear, respectively.

In FIG. 9, a seventh dashed line curve 400 represents the spectrum of the left perceived audio signal $e_L$, that is, the audio signal perceived by the left ear of the user 22 when the crosstalk reduction device 40 according to the second embodiment is in operation; and an eighth solid line curve 410 represents the spectrum of the audio signal perceived by the left ear of the user 22 in the absence of crosstalk reduction. Each perceived audio signal spectrum is a curve representing the amplitude, expressed in decibels or dB, of the perceived audio signal as a function of its frequency, expressed in Hertz or Hz.

A ninth curve 420 then shows the improvement perceived by the user's left ear 22 resulting from the implementation of the crosstalk reduction device 40 according to the second embodiment of the invention.

In FIG. 10, a tenth dashed curve 450 represents the spectrum of the right perceived audio signal $e_R$, that is, the audio signal perceived by the right ear of the user 22 when the crosstalk reduction device 40 according to the second embodiment is in operation; and an eleventh solid curve 460 represents the spectrum of the audio signal perceived by the right ear of the user 22 in the absence of crosstalk reduction. Each perceived audio signal spectrum is a curve representing the amplitude, expressed in decibels or dB, of the perceived audio signal as a function of its frequency, expressed in Hertz or Hz.

A twelfth curve 470 then shows the improvement perceived by the user's right ear 22 resulting from the implementation of the crosstalk reduction device 40 according to the second embodiment of the invention.

The crosstalk reduction with the crosstalk reduction device 40 according to the second embodiment then remains significant up to about 3 kHz, with an improvement of up to 20 dB for the right ear of the user 22 and up to 10 dB for the left ear.

It is conceivable then that the crosstalk reduction device 40 and associated crosstalk reduction method can further reduce the crosstalk between the two pairs 32, 34 of loudspeakers, and thus improve the listening experience of the user 22 perceiving the sound broadcast by the first pair 32 of loudspeakers by limiting the crosstalk resulting from the second pair 34 of loudspeakers, and thus provide him with a better audio experience.

The invention claimed is:

1. An electronic crosstalk reduction device for reducing crosstalk in an audio system, the audio system including a first pair of right and left loudspeakers for broadcasting acoustic signals to a user, a second pair of right and left loudspeakers, distinct from the first pair, for broadcasting acoustic signals to another user, and first and second distinct audio sources, the crosstalk reduction device being adapted to be connected to the output of each audio source and to the input of the first pair of loudspeakers, the crosstalk reduction device comprising:

an acquisition module configured to acquire first right and left audio signals from the first source, and second right and left audio signals from the second source;

a determination module configured to determine two right, and respectively two left, crosstalk reduction filters, each of which is adapted to reduce the crosstalk resulting from a respective loudspeaker of the second pair for the respective user's ear;

a calculation module configured to calculate a right, and respectively a left, corrective signal by applying the right, and respectively the left, crosstalk reduction filters to the second audio signals;

a generation module configured to generate a right, and respectively a left, first corrected audio signal to be played through the right, and respectively the left, loudspeaker of the first pair while playing the second right and left audio signals through the right and left loudspeakers of the second pair, each first corrected audio signal being obtained from the respective first audio signal and the corresponding corrective signal;

wherein each respective crosstalk reduction filter is obtained from first and second predefined transfer functions, each first transfer function representing an acoustic path between a loudspeaker of the first pair and a respective user's ear, and each second transfer function representing an acoustic path between a loudspeaker of the second pair and a respective user's ear, wherein each respective crosstalk reduction filter is obtained from at least one respective second transfer function and at least one respective inverse filter, each respective inverse filter being obtained by inverting at least one first transfer function, and wherein the determination module is configured to determine each respective crosstalk reduction filter in the frequency domain, and wherein the determination module is configured to determine the crosstalk reduction filters according to the following equations:

$$G_{ILL}(z)=-J_{SLL}(z)\cdot H_{ILL}(z)$$

$$G_{IRL}(z)=-J_{SLL}(z)\cdot H_{IRL}(z)$$

$$G_{ILR}(z)=-J_{SRR}(z)\cdot H_{ILR}(z)$$

$$G_{IRR}(z)=-J_{SRR}(z)\cdot H_{IRR}(z)$$

where $G_{ILL}$, $G_{IRL}$, $G_{ILR}$, $G_{IRR}$ represent the crosstalk reduction filters, $H_{ILL}$, $H_{IRL}$, $H_{ILR}$, $H_{IRR}$ represent the respective second transfer functions, and $J_{SLL}$, $J_{SRR}$ represent respective inverse filters, each equal to the inverse of the corresponding first transfer function $H_{SLL}$, $H_{SRR}$.

2. The device according to claim 1, wherein the calculation module is configured to calculate each corrective signal in the frequency domain.

3. The device according to claim 1, wherein, for the inversion of at least a first transfer function, the determination module is configured to add a regularization term to the denominator of a fraction representing said inversion.

4. The device according to claim 3, wherein the regularization term is frequency dependent.

5. The device according to claim 4, wherein the regularization term has a minimum constant value for a predetermined range of frequencies and a value tending toward infinity outside said range.

6. An electronic crosstalk reduction device for reducing crosstalk in an audio system, the audio system including a first pair of right and left loudspeakers for broadcasting acoustic signals to a user, a second pair of right and left loudspeakers, distinct from the first pair, for broadcasting acoustic signals to another user, and first and second distinct audio sources, the crosstalk reduction device being adapted to be connected to the output of each audio source and to the input of the first pair of loudspeakers, the crosstalk reduction device comprising:

an acquisition module configured to acquire first right and left audio signals from the first source, and second right and left audio signals from the second source;

a determination module configured to determine two right, and respectively two left, crosstalk reduction filters, each of which is adapted to reduce the crosstalk resulting from a respective loudspeaker of the second pair for the respective user's ear;

a calculation module configured to calculate a right, and respectively a left, corrective signal by applying the right, and respectively the left, crosstalk reduction filters to the second audio signals;

a generation module configured to generate a right, and respectively a left, first corrected audio signal to be played through the right, and respectively the left, loudspeaker of the first pair while playing the second right and left audio signals through the right and left loudspeakers of the second pair, each first corrected audio signal being obtained from the respective first audio signal and the corresponding corrective signal;

wherein each respective crosstalk reduction filter is obtained from first and second predefined transfer functions, each first transfer function representing an acoustic path between a loudspeaker of the first pair and a respective user's ear, and each second transfer function representing an acoustic path between a loudspeaker of the second pair and a respective user's ear, wherein each respective crosstalk reduction filter is obtained from at least one respective second transfer function and at least one respective inverse filter, each respective inverse filter being obtained by inverting at least one first transfer function, wherein the determination module is configured to determine each respective crosstalk reduction filter in the frequency domain, and wherein the determination module is configured to determine the crosstalk reduction filters according to the following equations:

$$G_{ILL}(z)=-J_{SLL}(z)\cdot H_{ILL}(z)-J_{SRL}(z)\cdot H_{ILR}(z)$$

$$G_{IRL}(z)=-J_{SLL}(z)\cdot H_{IRL}(z)-J_{SRL}(z)\cdot H_{IRR}(z)$$

$$G_{ILR}(z)=-J_{SRR}(z)\cdot H_{ILR}(z)-J_{SLR}(z)\cdot H_{ILL}(z)$$

$$G_{IRR}(z)=-J_{SRR}(z)\cdot H_{IRR}(z)-J_{SLR}(z)\cdot H_{IRL}(z)$$

where $G_{ILL}$, $G_{IRL}$, $G_{ILR}$, $G_{IRR}$ represent the crosstalk reduction filters, $H_{ILL}$, $H_{IRL}$, $H_{ILR}$, $H_{IRR}$ represent the respective second transfer functions, and $J_{SLL}$, $J_{SRL}$, $JSL_R$, $J_{SRR}$ represent the respective inverse filters.

7. The device according to claim 6, wherein, for the inversion of at least a first transfer function, the determination module is configured to add a regularization term to the denominator of a fraction representing said inversion.

8. An electronic crosstalk reduction device for reducing crosstalk in an audio system, the audio system including a first pair of right and left loudspeakers for broadcasting acoustic signals to a user, a second pair of right and left loudspeakers, distinct from the first pair, for broadcasting acoustic signals to another user, and first and second distinct audio sources, the crosstalk reduction device being adapted to be connected to the output of each audio source and to the input of the first pair of loudspeakers, the crosstalk reduction device comprising:

an acquisition module configured to acquire first right and left audio signals from the first source, and second right and left audio signals from the second source;

a determination module configured to determine two right, and respectively two left, crosstalk reduction filters, each of which is adapted to reduce the crosstalk resulting from a respective loudspeaker of the second pair for the respective user's ear;

a calculation module configured to calculate a right, and respectively a left, corrective signal by applying the right, and respectively the left, crosstalk reduction filters to the second audio signals;

a generation module configured to generate a right, and respectively a left, first corrected audio signal to be played through the right, and respectively the left, loudspeaker of the first pair while playing the second right and left audio signals through the right and left loudspeakers of the second pair, each first corrected audio signal being obtained from the respective first audio signal and the corresponding corrective signal;

wherein each respective crosstalk reduction filter is obtained from first and second predefined transfer functions, each first transfer function representing an acoustic path between a loudspeaker of the first pair and a respective user's ear, and each second transfer function representing an acoustic path between a loudspeaker of the second pair and a respective user's ear, wherein each respective crosstalk reduction filter is obtained from at least one respective second transfer function and at least one respective inverse filter, each respective inverse filter being obtained by inverting at least one first transfer function, wherein the determination module is configured to determine each respective crosstalk reduction filter in the frequency domain, wherein the calculation module is configured to calculate each corrective signal in the frequency domain, and wherein the calculation module is configured to compute the corrective signals according to the following equations:

$$C_L(z)=G_{ILL}(z)\cdot Y_{IL}(z)+G_{IRL}(z)\cdot Y_{IR}(z)$$

$$C_R(z)=G_{ILR}(z)\cdot Y_{IL}(z)+G_{IRR}(z)\cdot Y_{IR}(z)$$

where $C_L$, $C_R$ represent the left, and respectively right, corrective signals, $G_{ILL}$, $G_{IRL}$, $G_{ILR}$, $G_{IRR}$ represent the crosstalk reduction filters, and $Y_{IL}$, $Y_{IR}$ represent the left, and respectively right, second audio signals.

9. The device according to claim 8, wherein, for the inversion of at least a first transfer function, the determination module is configured to add a regularization term to the denominator of a fraction representing said inversion.

* * * * *